US012747530B2

(12) United States Patent
Lv et al.

(10) Patent No.: US 12,747,530 B2
(45) Date of Patent: Sep. 29, 2026

(54) WASHING MACHINE AND CONTROL METHOD FOR WASHING MACHINE

(71) Applicants: Qingdao Haier Laundry Electric Appliances Co., Ltd., Qingdao (CN); Haier Smart Home Co., Ltd., Qingdao (CN)

(72) Inventors: Yanfen Lv, Qingdao (CN); Sheng Xu, Qingdao (CN)

(73) Assignees: QINGDAO HAIER LAUNDRY ELECTRIC APPLIANCES CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 174 days.

(21) Appl. No.: 18/717,293

(22) PCT Filed: Dec. 6, 2022

(86) PCT No.: PCT/CN2022/136975
§ 371 (c)(1),
(2) Date: Jun. 6, 2024

(87) PCT Pub. No.: WO2023/104040
PCT Pub. Date: Jun. 15, 2023

(65) Prior Publication Data

US 2025/0034787 A1 Jan. 30, 2025

(30) Foreign Application Priority Data

Dec. 6, 2021 (CN) ..... 202111476476.9
Dec. 6, 2021 (CN) ..... 202111477773.5
(Continued)

(51) Int. Cl.
*D06F 39/10* (2006.01)
*D06F 39/02* (2006.01)
(Continued)

(52) U.S. Cl.
CPC ..... *D06F 39/10* (2013.01); *D06F 39/02* (2013.01); *D06F 39/085* (2013.01); *D06F 39/20* (2024.01); *D06F 23/02* (2013.01)

(58) Field of Classification Search
CPC ..... D06F 39/02; D06F 39/10; D06F 39/20; D06F 39/085; D06F 23/02
See application file for complete search history.

(56) References Cited

U.S. PATENT DOCUMENTS

2018/0112346 A1* 4/2018 Hao ..... B08B 5/02
2020/0270795 A1* 8/2020 Zarcone ..... D06F 34/22
2021/0254259 A1* 8/2021 Huang ..... D06F 33/37

FOREIGN PATENT DOCUMENTS

CN 1966806 A 5/2007
CN 104805651 A 7/2015
(Continued)

OTHER PUBLICATIONS

Machine translation of EP 3832001 A1 to Eiselt et al. (Year: 2020).*
(Continued)

*Primary Examiner* — Joseph L. Perrin
(74) *Attorney, Agent, or Firm* — Panitch Schwarze Belisario & Nadel LLP

(57) ABSTRACT

Described are a washing machine and a control method for the washing machine. The washing machine includes: a water container; a filtering device, being configured to connect to the water container and to receive water in the water container for filtering, and has a sewage outlet for discharging sewage to the outside; a suction device, being configured to perform a suction action, drives the sewage in the filtering device to be discharged through the sewage outlet under the action of a pressure difference; and a recovery device, being configured to collect the sewage discharged by the filtering device. The recovery device can collect the sewage discharged by the filtering device, and a
(Continued)

pressure difference can be formed inside and outside the sewage outlet of the filtering device through the suction action of the suction device, providing a driving force for the sewage to be discharged from the filtering device.

18 Claims, 12 Drawing Sheets

(30) Foreign Application Priority Data

| | | |
|---|---|---|
| Dec. 6, 2021 | (CN) | 202111477792.8 |
| Dec. 6, 2021 | (CN) | 202111477802.8 |
| Dec. 6, 2021 | (CN) | 202111477804.7 |
| Dec. 6, 2021 | (CN) | 202111477809.X |
| Dec. 6, 2021 | (CN) | 202111477838.6 |

(51) Int. Cl.

| | |
|---|---|
| ***D06F 39/08*** | (2006.01) |
| ***D06F 39/20*** | (2024.01) |
| *D06F 23/02* | (2006.01) |

(56) References Cited

FOREIGN PATENT DOCUMENTS

| | | | | |
|---|---|---|---|---|
| CN | 104975475 | A | 10/2015 | |
| CN | 204690380 | U | 10/2015 | |
| CN | 105088697 | A | 11/2015 | |
| CN | 106436239 | A | 2/2017 | |
| CN | 107177953 | A | 9/2017 | |
| CN | 109957924 | A | 7/2019 | |
| CN | 109957937 | A | 7/2019 | |
| CN | 111714059 | A | 9/2020 | |
| CN | 111719288 | A | 9/2020 | |
| CN | 112914464 | A | 6/2021 | |
| CN | 217266428 | U | 8/2022 | |
| CN | 217266429 | U | 8/2022 | |
| CN | 217266430 | U | 8/2022 | |
| CN | 217266431 | U | 8/2022 | |
| EP | 3832001 | A1 * | 6/2021 | A47L 15/4214 |
| JP | H0395895 | U | 9/1991 | |
| JP | 2001286698 | A | 10/2001 | |
| JP | 2001300191 | A | 10/2001 | |
| JP | 2002066198 | A | 3/2002 | |
| WO | WO-2020052508 | A1 * | 3/2020 | D06F 39/022 |
| WO | WO-2021116933 | A1 * | 6/2021 | D06F 39/10 |

OTHER PUBLICATIONS

International Search Report with English translation, and Written Opinion issued Mar. 1, 2023, in PCT/CN2022/136975.

English Translation of Office Action issued on Jul. 29, 2025, by the Japanese Patent Office in corresponding JP Application No. 2024-533839 (7 pages).

Extended European Search Report issued on Mar. 10, 2025, by the European Patent Office in corresponding EP Application No. 22903462.4 (11 pages).

Office Action issued on Mar. 4, 2026, by the State Intellectual Property Office of People's Republic of China in corresponding CN Application No. 202110789651.3, and English translation of the Office Action (10 pages).

Office Action issued on Mar. 4, 2026, by the State Intellectual Property Office of People's Republic of China in corresponding CN Application No. 202311014365.5, and English translation of the Office Action (13 pages).

* cited by examiner

WASHING MACHINE AND CONTROL METHOD FOR WASHING MACHINE

CROSS-REFERENCE TO RELATED APPLICATIONS

This application is a Section 371 of International Application No. PCT/CN2022/136975, filed Dec. 6, 2022, which was published in the Chinese language on Jun. 15, 2023, under International Publication No. WO 2023/104040 A1, which claims priority under 35 U.S.C. § 119(b) to Chinese Application No. 202111477792.8, filed Dec. 6, 2021, Chinese Application No. 202111476476.9, filed Dec. 6, 2021, Chinese Application No. 202111477773.5, filed Dec. 6, 2021, Chinese Application No. 202111477809.X, filed Dec. 6, 2021, Chinese Application No. 202111477802.8, filed Dec. 6, 2021, Chinese Application No. 202111477804.7, filed Dec. 6, 2021, and Chinese Application No. 202111477838.6, filed Dec. 6, 2021, the disclosures of which are incorporated herein by reference in their entirety.

TECHNICAL FIELD

The present disclosure belongs to the technical field of washing machines, and in particular, relates to a washing machine and a control method for the washing machine.

BACKGROUND

During the washing process, due to the friction between the clothes and between the clothes and the washing machine itself, the clothes will produce lint and mix into the washing water. If the lint in the washing water cannot be removed, it is likely to adhere to the surface of the clothes after washing, affecting the washing effect of the clothes. For this reason, the existing washing machine is equipped with a filter for filtering lint, and the washing water is circulated through the filter during the washing process to remove the lint from the washing water.

The filter of an existing washing machine is generally set inside the inner drum or the drain pump to filter out lint and debris in the washing water. However, after a long period of use, the filter will be filled with lint and other filter impurities, which will affect the filtering effect of the filter, cause the sewage valve/drain pump to be blocked, and easily breed bacteria. It needs to be cleaned in time, otherwise it will cause pollution of the washing water, secondary pollution of clothes, and affect the health of users. However, most washing machines require users to remove the filter and clean it manually, which is inconvenient to operate.

In view of the above problems, the prior art has proposed a filtering device with a self-cleaning function, which can automatically discharge the attached filter impurities. Most washing machines using the above filtering device directly discharge the sewage carrying the filter impurities into the drainage water flow of the washing machine after completing the self-cleaning of the filtering device, which brings the following problems.

On the one hand, since the internal space of the washing machine is relatively compact, the sewage discharge path of the filtering device is long, and there may be a certain height difference, making it difficult to fully discharge the sewage in the filtering device without the aid of driving force, resulting in residual sewage in the filtering device. Long-term use will still cause problems such as bacterial growth.

On the other hand, in recent years, the concept of microplastics has been proposed in the field of environmental protection and has gradually received increasing attention. Microplastics generally refer to plastic fragments and particles with a diameter of less than 5 mm. When mixed into the natural water environment, they can easily adsorb organic pollutants in the water due to their high specific surface area, forming organic pollution spheres. Microplastics wandering in the water are easily eaten by low-end food chain organisms such as mussels and zooplankton. Since microplastics cannot be digested, when these bottom-end food chain organisms are preyed upon by upper-level organisms, microplastics will continue to accumulate in the upper-level organisms. As the top organisms in the food chain, humans' food sources include the above-mentioned organisms that accumulate microplastics in their bodies, which will cause the accumulation of microplastics in the human body, which may have an impact on human health.

Studies have found that an important source of microplastics is the wastewater discharged from household washing machines. This is because washing machines will rinse off clothing fibers when washing clothes, and with the popularization of chemical fiber fabrics, these shed clothing fibers are discharged with the drainage water flow of the washing machine and become microplastics mixed into the natural water environment. At the same time, microplastics may also come from industrial products made of plastic materials, and the outer drum, drainage pipe and other structures in the washing machine are generally made of plastic. After long-term use, it is inevitable that plastic fragments will fall off due to aging and other reasons. Therefore, how to reduce the content of microplastics in the drainage of washing machines has become an urgent problem to be solved in the field of environmental protection. However, in the washing machines with self-cleaning functions of the filtering devices in the prior art, because the filtered impurities containing microplastics are directly discharged into the drainage water flow of the washing machine, there is a problem of excessively high content of microplastics in the drainage of the washing machine.

In view of this, the present disclosure is proposed.

SUMMARY

The technical problem to be solved by the present disclosure is to overcome the deficiencies of the prior art and provide a washing machine and a control method for the washing machine.

In order to solve the above technical problems, the first goal of the present disclosure is to provide a washing machine and a control method thereof, which provides a driving force for the discharge of sewage in the filtering device by forming a pressure difference inside and outside the sewage outlet of the filtering device. Specifically, the following technical solutions are adopted:

A washing machine, comprising:

a water container;

a filtering device, being configured to communicate with the water container and to receive water from the water container for filtering, and has a sewage outlet for discharging sewage to outside;

a suction device, being configured to perform a suction action to drive the sewage in the filtering device to be discharged through the sewage outlet under an action of pressure difference; and a recovery device, being configured to collect the sewage discharged from the filtering device.

Furthermore, the suction device is connected to the sewage outlet of the filtering device and the recovery device through a suction pipeline, and performs the suction action according to an instruction;

preferably, the suction device is an air pump.

Furthermore, the sewage outlet of the filtering device is connected to a sewage temporary storage device having an internal cavity, the sewage temporary storage device is connected to the recovery device, and the suction pipeline is connected to the internal cavity of the sewage temporary storage device.

The suction device performs the suction action, and the sewage in the filtering device enters the sewage temporary storage device under the action of the pressure difference; the suction device is turned off, and the sewage in the sewage temporary storage device is discharged into the recovery device.

Preferably, the sewage temporary storage device is provided with an air hole for connecting the internal cavity of the sewage temporary storage device with the outside; the suction device is turned off, and external air enters the internal cavity of the sewage temporary storage device through the air hole, driving the sewage therein to be discharged into the recovery device.

More preferably, the air hole is arranged in a top area of the sewage temporary storage device. Furthermore, a water outlet of the sewage temporary storage device is higher than a sewage inlet of the recovery device, the suction device is turned off, and the sewage in the sewage temporary storage device is discharged into the recovery device under an action of gravity.

And/or, the washing machine also includes an inflating device for introducing air into the sewage temporary storage device to drive the sewage therein to be discharged into the recovery device; or the suction device is also used for introducing air into the sewage temporary storage device to drive the sewage therein to be discharged into the recovery device.

Furthermore, a buffer portion is arranged between the suction device and the sewage temporary storage device, and a buffer chamber is provided inside the buffer portion; the buffer chamber is communicated with the internal cavity of the sewage temporary storage device, and the suction pipeline is connected to the buffer portion to conduct the suction device and the buffer chamber.

Furthermore, an openable/closable sewage valve is provided between the sewage outlet of the filtering device and a suction inlet end of the suction pipeline.

Preferably, the sewage outlet of the filtering device is connected to the sewage temporary storage device having the internal cavity, the sewage temporary storage device is connected to the recovery device, the suction pipeline is connected to the sewage temporary storage device, and the sewage valve is arranged between the sewage outlet of the filtering device and the sewage temporary storage device.

Furthermore, the recovery device comprises:

a housing with a recovery chamber therein;

a filter component is disposed in the recovery chamber and divides the recovery chamber into a first chamber and a second chamber;

the sewage carrying filtered impurities enters the first chamber, and enters the second chamber after being filtered by the filter component, the filtered impurities are collected in the first chamber.

Preferably, a water outlet is provided on the second chamber for discharging filtered clean water.

A control method for the washing machine as described above comprising: controlling the suction device to perform the suction action, the sewage in the filtering device being discharged into the recovery device through the sewage outlet under the action of the pressure difference.

Furthermore, the sewage outlet of the filtering device is connected to the sewage temporary storage device having the internal chamber, the sewage temporary storage device is connected to the recovery device, and the suction device is connected to the sewage temporary storage device.

The control method comprises the following steps:

S1, controlling the suction device to perform the suction action, air in the sewage temporary storage device is sucked out, and the sewage in the filtering device is discharged into the sewage temporary storage device under the action of the pressure difference;

S2, turning off the suction device, and discharging the sewage in the sewage temporary storage device into the recovery device.

Preferably, the water outlet of the sewage temporary storage device is higher than the sewage inlet of the recovery device, in step S2, the sewage in the sewage temporary storage device is discharged into the recovery device under the action of gravity.

Preferably, the washing machine further comprises an inflating device connected to the sewage temporary storage device, and step S2 comprises: turning off the suction device, turning on the inflating device, introducing air into the sewage temporary storage device, and driving the sewage therein to be discharged into the recovery device.

Alternatively, the suction device is also used to introduce air into the sewage temporary storage device, and step S2 includes: turning off the suction device, and controlling the suction device to perform an air pumping action to introduce air into the sewage temporary storage device to drive the sewage therein to be discharged into the recovery device.

Furthermore, a sewage valve that can be opened/closed is provided between the filtering device and the sewage temporary storage device.

Step S1 specifically includes the following steps:

S11, controlling the suction device to perform the suction action, and the air in the sewage temporary storage device is sucked out;

S12, opening the sewage valve, and the sewage in the filtering device is discharged into the sewage temporary storage device under the action of pressure difference.

The second goal of the present disclosure is to provide a washing machine, which can quickly form a pressure difference inside and outside the sewage outlet of the filtering device by using a unidirectional blocking member installed on the recovery device in cooperation with a suction device. Specifically, the following technical solutions are adopted:

A washing machine, comprising:

a water container;

a filtering device, being configured to communicate with the water container and to receive water in the water container for filtering, and has a sewage outlet for discharging sewage to outside;

a suction device, being configured to perform a suction action to drive the sewage in the filtering device to be discharged through the sewage outlet under an action of pressure difference;

a recovery device, being configured to collect the sewage discharged from the filtering device.

A blocking member that conducts one-way from outside to inside is arranged at a sewage inlet of the recovery device; or, the recovery device is provided with a water outlet, and the blocking member that conducts one-way from inside to outside is arranged at the water outlet.

Furthermore, the blocking member is arranged at the sewage inlet of the recovery device and is one-way conducted from outside to inside; the blocking member comprises:

a base body, mounted on the sewage inlet of the recovery device;

an opening portion, being movable relative to the base body to open/close space outside and inside the recovery device.

Furthermore, an outer periphery of the sewage inlet extends a certain length from an inner wall of the recovery device to the inside of the recovery device to form a tubular portion; the base body is installed at an extended end of the tubular portion, and the opening portion is relatively movable with the extended end of the tubular portion to open/block an opening of the extended end of the tubular portion.

Furthermore, the base body is sleeved on the extended end of the tubular portion; the opening portion covers the opening of the tubular portion from outside of the tubular portion to achieve blocking, and the opening portion flips in a direction away from the tubular portion to open the opening.

Furthermore, the opening portion is made of a flexible material, and when the suction device is turned on, a portion of the opening portion covering the opening is deformed to bulge toward the inside of the tubular portion, thereby sealing the opening.

Furthermore, the opening portion is made of a hard material, and a surface of the opening portion facing the opening is a convex surface protruding toward the inside of the tubular portion.

Furthermore, a periphery of the sewage inlet extends a certain length from an outer wall of the recovery device to the outside of the recovery device to form a connecting portion, the connecting portion is connected to a pipeline, and the pipeline is connected to the sewage outlet of the filtering device.

Furthermore, the opening portion and the base body are integrally formed; or, the opening portion and the base body are separately provided and are movably connected relative to each other.

Furthermore, the sewage outlet of the filtering device is connected to a sewage temporary storage device having an internal cavity, and the sewage temporary storage device is connected to the recovery device; the suction device is connected to the internal cavity of the sewage temporary storage device to suck air inside the sewage temporary storage device.

Furthermore, a buffer portion is provided between the suction device and the sewage temporary storage device, the buffer portion is provided with a buffer chamber inside, and the buffer chamber is communicated with the internal cavity of the sewage temporary storage device and the suction device respectively.

The third goal of the present disclosure is to provide a washing machine, in which a sewage temporary storage device capable of storing sewage is arranged between the filtering device and the recovery device to prevent the sewage from being sucked into the suction device. Specifically, the following technical solutions are adopted:

A washing machine, comprising:

a water container;

a filtering device, being configured to communicate with the water container and to receive water in the water container for filtering, and has a sewage outlet for discharging sewage to outside;

a sewage temporary storage device, having an internal cavity connected to the sewage outlet of the filtering device;

a recovery device, being configured to connect to the internal cavity of the sewage temporary storage device, and the sewage discharged by the filtering device is collected in the recovery device through the sewage temporary storage device;

a suction device, being configured to perform a suction action to drive the sewage in the filtering device into the sewage temporary storage device under an action of pressure difference.

Furthermore, the sewage temporary storage device is provided with a first vent hole connected to the suction device.

Furthermore, the sewage temporary storage device is provided with an air hole for connecting the internal cavity of the sewage temporary storage device with the outside.

The suction device performs the suction action, and the sewage in the filtering device enters the sewage temporary storage device under the action of the pressure difference; the suction device is turned off, and the external air enters the internal cavity of the sewage temporary storage device through the air hole, driving the sewage therein to be discharged into the recovery device.

Furthermore, a buffer portion is provided between the suction device and the sewage temporary storage device, and a buffer chamber is provided inside the buffer portion; the buffer chamber is communicated with the first vent hole on the sewage temporary storage device, and the suction device is communicated with the buffer chamber.

Furthermore, the buffer portion is provided with a second vent hole connected to the suction device.

Furthermore, the second vent hole of the buffer portion is connected to a suction pipeline, and the suction pipeline is extended to be connected to an air inlet end of the suction device.

Furthermore, the first vent hole of the sewage temporary storage device is connected to a ventilation pipeline, and the ventilation pipeline extends to communicate with the buffer chamber of the buffer portion.

Furthermore, the water outlet of the sewage temporary storage device is higher than the sewage inlet of the recovery device, the suction device is turned off, and the sewage in the sewage temporary storage device is discharged into the recovery device under an action of gravity;

And/or, the washing machine also includes an inflating device for introducing air into the sewage temporary storage device to drive the sewage therein to be discharged into the recovery device; or the suction device is also used for introducing air into the sewage temporary storage device to drive the sewage therein to be discharged into the recovery device.

Furthermore, the washing machine further comprises a detection device for detecting a discharge of the sewage in the filtering device; the suction device is configured to stop the suction action when the detection device detects that the sewage in the filtering device is completely discharged.

Furthermore, an amount of the sewage that can be accommodated between the sewage outlet of the filtering device and the sewage inlet of the recovery device is greater than or equal to a maximum amount of the sewage that can be accommodated by the filtering device.

Preferably, a volume of the sewage temporary storage device is greater than or equal to a volume of the filtering device.

The fourth goal of the present disclosure is to provide a washing machine, which can automatically disconnect the connection between the suction device and the sewage outlet of the filtering device when the sewage discharged by the filtering device reaches a certain amount, so as to prevent the sewage from being sucked into the suction device. Specifically, the following technical solutions are adopted:

A washing machine, comprising:

a water container;

a filtering device, being configured to communicate with the water container and to receive water in the water container for filtering, and has a sewage outlet for discharging sewage to outside;

a suction device, being configured to perform a suction action to drive the sewage in the filtering device to be discharged through the sewage outlet under an action of pressure difference;

a recovery device, being configured to collect the sewage discharged from the filtering device;

an isolation mechanism, being arranged between the sewage outlet and the suction device, and disconnects a connection between the suction device and the sewage outlet as the sewage is discharged.

Furthermore, the isolation mechanism comprises a floating member, and an air vent is provided on a communication path between the suction device and the sewage outlet; during the sewage discharge process, the floating member rises with a water surface to the air vent to block the air vent.

Preferably, the floating member is a floating ball, and a diameter of the floating ball is larger than a diameter of the air vent.

Furthermore, the filtering device is connected to a sewage temporary storage device having an internal cavity, and the sewage temporary storage device is connected to the recovery device; the suction device is connected to the internal cavity of the sewage temporary storage device to suck air inside the sewage temporary storage device.

The floating member is arranged inside the sewage temporary storage device, and the air vent is arranged on the sewage temporary storage device; and/or the floating member is arranged between the sewage temporary storage device and the suction device.

Furthermore, a buffer portion is provided between the suction device and the sewage temporary storage device, the buffer portion has a buffer chamber inside, and the buffer chamber is communicated with the internal cavity of the sewage temporary storage device and the suction device respectively.

The floating member is arranged inside the sewage temporary storage device, and the air vent is arranged on the sewage temporary storage device; and/or the floating member is arranged inside the buffer portion, and the air vent is arranged on the buffer portion.

Furthermore, the isolation mechanism further comprises a guiding part extending from a bottom of the sewage temporary storage device to the air vent, the guiding part having a hollow channel, and the floating member is arranged in the hollow channel.

Preferably, the guiding part is arranged to extend vertically.

Furthermore, a through hole for connecting the hollow channel with external space of the guiding part is provided on a side wall of the guiding part.

Furthermore, the floating member is the floating ball, the guiding part is a circular tubular structure, and an inner diameter of the guiding part is greater than an outer diameter of the floating ball.

Furthermore, the sewage temporary storage device is connected to a ventilation pipeline, and the ventilation pipeline is connected to the suction device; the floating member is the floating ball arranged inside the sewage temporary storage device, and a diameter of the floating ball is larger than a diameter of the ventilation pipeline.

Furthermore, the floating member is the floating ball, and a ventilation pipeline is arranged between the sewage temporary storage device and the suction device; the ventilation pipeline has a reduced diameter section extending from bottom to top with a gradually decreasing diameter, and the floating ball is arranged inside the reduced diameter section; a diameter of a top of the reduced diameter section is smaller than the diameter of the floating ball, and the floating ball rises with the water surface to the top of the reduced diameter section to achieve blocking.

Furthermore, an air hole is provided on the sewage temporary storage device, and the air hole is unidirectionally conductive from outside to inside of the sewage temporary storage device.

The fifth goal of the present disclosure is to provide a washing machine, wherein the recovery device can collect and filter the sewage discharged by the filtering device, and then pass it into the water container again, effectively preventing the problem of overflow of the recovery device. Specifically, the following technical solutions are adopted:

A washing machine, comprising:

a water container;

a filtering device, being configured to communicate with the water container and to receive water in the water container for filtering, and has a sewage outlet for discharging sewage to outside;

a suction device, being configured to perform a suction action to pump out the sewage in the filtering device through the sewage outlet;

a recovery device, being configured to collect and filter the sewage pumped out by the suction device, and filtered water is passed into the water container.

Furthermore, the washing machine also includes a detergent dispensing device connected to the water container and used for dispensing detergent into the water container; the recovery device is connected to the detergent dispensing device, and the filtered water in the recovery device is passed into the water container through the detergent dispensing device.

Furthermore, the detergent dispensing device includes a water inlet box connected to the water container; the recovery device includes a housing and a filter component arranged inside the housing, and the filter component is used to filter the sewage collected; a water outlet is arranged on the housing to discharge the filtered water, and the water outlet is connected to the water inlet box.

Furthermore, the housing has a recovery chamber inside, the filter component divides the recovery chamber into a first chamber and a second chamber, and the water outlet on the housing is connected to the second chamber.

The sewage carrying filtered impurities enters the first chamber, is filtered by the filter component, and then enters the second chamber, the filtered impurities are collected in the first chamber.

Preferably, the first chamber is arranged above the second chamber.

Furthermore, the housing of the recovery device is arranged inside the water inlet box, and the filtered water in the recovery device flows out through the water outlet and directly enters the water inlet box.

Preferably, the housing is insertable/removable and is arranged inside the water inlet box.

More preferably, the filter component is detachably installed inside the housing.

Furthermore, the water outlet is connected to the water inlet box through a pipeline, and the filtered water in the recovery device is discharged from the water outlet and enters the water inlet box through the pipeline.

Preferably, the housing is insertable/extractable and is arranged inside a box body of the washing machine.

More preferably, the filter component is detachably installed inside the housing.

Furthermore, the water inlet box is connected to a water inlet pipe, and the water inlet pipe is connected to the water container.

Preferably, a water outlet end of the water inlet pipe is connected to the water container, and the water inlet pipe comprises a corrugated pipe with a certain length.

Furthermore, the sewage outlet of the filtering device is connected to a sewage temporary storage device having an internal cavity, the sewage temporary storage device is connected to the recovery device, and the suction device is connected to the internal cavity of the sewage temporary storage device to suck air inside the sewage temporary storage device.

Furthermore, a buffer portion is arranged between the suction device and the sewage temporary storage device, the buffer portion has a buffer chamber inside, and the buffer chamber is respectively connected to the internal cavity of the sewage temporary storage device and the suction device.

Furthermore, an openable/closable sewage valve is provided between the filtering device and the sewage temporary storage device.

The sixth goal of the present disclosure is to provide a control method for a washing machine and a washing machine, which can control the suction device to automatically turn off when a certain condition is reached during the suction action, thereby preventing a large amount of sewage from being discharged into the filtering device at one time, causing the sewage temporary storage device to overflow and enter the suction device. Specifically, the following technical solutions are adopted:

A control method for a washing machine, wherein the washing machine comprises:

a water container;

a filtering device, being configured to communicate with the water container and to receive water in the water container for filtering, and has a sewage outlet for discharging sewage to outside;

a sewage temporary storage device, being configured to connect to the sewage outlet of the filtering device;

a recovery device, being configured to connect to the sewage temporary storage device;

a suction device, being configured to perform a suction action.

The control method is used in a sewage discharge process of the filtering device, and comprising:

S1', controlling the suction device to perform the suction action, sucking air in the sewage temporary storage device, and the sewage in the filtering device being discharged into the sewage temporary storage device under the action of the pressure difference;

S2', turning off the suction device when a first set condition is reached, and the sewage in the sewage temporary storage device enters the recovery device.

Furthermore, in step S2', the first set condition is that a duration of the suction action reaches a first preset time $t_1$, or a water level in the sewage temporary storage device rises to a first set water level.

Furthermore, after step S2', it further comprises step S3': when a second set condition is reached, returning to step S1'.

Furthermore, in step S3', the second set condition is that the suction device is turned off for a second preset time $t_2$, or the water level in the sewage temporary storage device drops to a second set water level.

Furthermore, between step S2' and step S3', step A is further included: judging whether a number of executions of step S1' reaches a preset number, if so, ending the sewage discharge process of the filtering device, if not, executing step S3'.

Furthermore, between step S1' and step S2', step B is further included: within a third preset time $t_3$, if the water level in the sewage temporary storage device does not reach a third set water level, the suction device is turned off to end the sewage discharge process of the filtering device, otherwise step S2' is executed.

A washing machine adopts the above-mentioned washing machine control method.

Furthermore, the first set condition is that the water level in the sewage temporary storage device rises to the first set water level.

A water level detection device is provided on the sewage temporary storage device, and when the water level in the sewage temporary storage device reaches the first set water level, the water level detection device sends out a warning signal.

Preferably, the water level detection device comprises a water level probe which is arranged inside the sewage temporary storage device and is flush with a height of the first set water level.

Alternatively, the water level detection device includes a float and a sensor capable of detecting a height of the float.

Furthermore, a volume of the sewage temporary storage device is smaller than a volume of the filtering device.

Furthermore, a buffer portion is arranged between the suction device and the sewage temporary storage device, and a buffer chamber is provided inside the buffer portion, and the buffer chamber is respectively connected to the suction device and the sewage temporary storage device.

The seventh goal of the present disclosure is to provide a washing machine and a control method thereof, which filters the drainage water flow of the washing machine before discharging it, thereby avoiding the problem of microplastics in the drainage water flow. Specifically, the following technical solutions are adopted:

A washing machine, comprising:

a water container;

a discharge pipeline, being configured to drain water to outside of the washing machine;

a filtering device, being configured to receive water in the water container for filtering, and being provided with a water inlet, a filtered water outlet and a sewage outlet.

The filtered water outlet is directly or indirectly connected to the discharge pipeline, and the water in the water container is discharged from the discharge pipeline after filtered impurities are removed by the filtering device.

The washing machine also includes a recovery device for collecting sewage carrying the filtered impurities discharged from the sewage outlet.

Furthermore, a first switching device is included, which is arranged between the filtered water outlet and the discharge pipeline, and controls the water container and the discharge pipeline to selectively connect to the filtered water outlet of the filtering device.

Preferably, a delivery pump is provided between the water container and a water inlet of the filtering device to deliver the water in the water container to the filtering device.

Furthermore, the first switching device comprises a first valve body having a first valve chamber; the first valve body is provided with a water inlet connected to the filtered water outlet, a circulating water outlet connected to the water container, and a drainage outlet connected to the discharge pipeline.

A switching mechanism is provided in the first valve chamber, and the switching mechanism selectively opens the circulating water outlet and the drainage outlet.

Preferably, the switching mechanism comprises:

a flap, being rotatably mounted in the first valve chamber and has a first surface and a second surface opposite to each other;

a drainage seal, being disposed on the first surface of the flap, for blocking the drainage outlet;

a circulation seal, being disposed on the second surface of the flap, for sealing the circulating water outlet.

More preferably, the first switching device further comprises a first driving element for driving the flap to rotate in the first valve chamber.

Furthermore, it also includes a sewage discharge control device, which is arranged between the sewage outlet of the filtering device and the recovery device, and is used to control the connection/disconnection between the sewage outlet and the recovery device.

Furthermore, the sewage discharge control device comprises a second valve body having a second valve chamber, a sewage inlet and a sewage outlet are arranged on the second valve body, and the sewage inlet is connected with the sewage discharge outlet; a blocking mechanism is arranged in the second valve chamber for blocking the sewage inlet or the sewage outlet.

Preferably, the sewage discharge control device further comprises a second driving element for driving the blocking mechanism to move in the second valve chamber to open/block the sewage inlet or sewage outlet.

Preferably, the washing machine further comprises a first switching device for controlling the water container and the discharge pipeline to selectively communicate with the filtered water outlet of the filtering device; the first switching device comprises the first valve body having the first valve chamber.

The second valve body is connected to the first valve body as a whole, and the first valve chamber and the second valve chamber are independent of each other.

Furthermore, the recovery device comprises:

a housing with a recovery chamber therein;

a filter component, being disposed in the recovery chamber and divides the recovery chamber into a first chamber and a second chamber.

The sewage carrying filtered impurities enters the first chamber, is filtered by the filter component, and then enters the second chamber, the filtered impurities are collected in the first chamber.

Furthermore, the recovery device is provided with a water outlet connected to the second chamber for discharging water filtered by the filter component.

Preferably, the water outlet is connected to the water container, and the filtered water flows into the water container; and/or, the water outlet is connected to a discharge pipeline, and the filtered water is discharged through the discharge pipeline.

More preferably, the water outlet is connected to the second switching device, and the second switching device controls the water container and the discharge pipeline to selectively connect to the water outlet.

Furthermore, a three-way structure is arranged between the water container and the water inlet of the filtering device, the three-way structure is connected to the discharge pipeline, and an openable/closable control valve is arranged between the three-way structure and the discharge pipeline.

A control method for the washing machine described above, wherein a delivery pump is arranged between the water container and the water inlet of the filtering device; during the drainage stage of the washing machine, the delivery pump is turned on, and the water in the water container passes into the filtering device, and after the filtered impurities are filtered out, the water is discharged through the discharge pipeline.

Furthermore, the washing machine further comprises a sewage discharge control device for controlling the connection/disconnection between the sewage discharge outlet of the recovery device and the filtering device.

During the sewage discharge process of the filtering device, the sewage discharge control device connects the sewage discharge outlet of the recovery device and the filtering device, and the sewage carrying the filtered impurities is discharged through the sewage discharge outlet and enters the recovery device to be collected.

Preferably, the washing machine further comprises a first switching device for controlling the water container and the discharge pipeline to selectively communicate with the filtered water outlet of the filtering device.

During the washing/rinsing process, the first switching device conducts the filtered water outlet between the water container and the filtering device, and the delivery pump is turned on, and the water in the water container circulates through the filtering device to filter out the filtered impurities in the water.

During the drainage stage of the washing machine, the first switching device connects the discharge pipeline and the filtered water outlet of the filtering device, the delivery pump is turned on, and the water in the water container is filtered by the filtering device to remove the filtered impurities and then discharged from the discharge pipeline.

After adopting the above technical scheme, the present disclosure has the following beneficial effects compared with the prior art.

1. By installing a recovery device in the washing machine, the sewage discharged from the filtering device can be collected to prevent the filtered impurities such as lint carried in the sewage from being directly discharged from the washing machine, thus avoiding the microplastics in the filtered impurities from entering the ecological cycle with the drainage water flow, causing impacts on the ecological environment and human health.

2. By performing the suction action through the suction device, a pressure difference can be formed inside and outside the sewage outlet of the filtering device, providing a driving force for the discharge of sewage in the filtering device, avoiding the situation where the sewage cannot be discharged due to the long distance or height difference between the filtering device and the recovery device.

3. The one-way conducting blocking member is arranged on the recovery device to cooperate with the suction device to ensure that a strong pressure difference can be quickly formed inside and outside the sewage outlet of the filtering device when the suction device performs the suction action, thereby providing a driving force for the discharge of sewage in the filtering device.

4. The sewage temporary storage device is set between the filtering device and the recovery device. The suction device performs suction action to form a negative pressure environment in the sewage temporary storage device, thereby using the pressure difference to drive the sewage to be discharged from the filtering device. The discharged sewage is stored in the sewage temporary storage device, thereby avoiding the situation where the sewage is sucked into the suction device due to the large suction force. The suction device does not directly contact the sewage during the entire process of sewage being discharged from the filtering device to the recovery device, avoiding the problem of pump body blockage that may exist in water pump transportation.

5. The isolation mechanism is used to disconnect the connection between the sewage outlet and the suction device when the sewage discharge reaches a certain amount, which can prevent the sewage from being sucked into the suction device and protect the suction device.

6. The recovery device can filter the collected sewage and re-introduce the filtered water into the water container, which can be used in the subsequent washing process or discharged through the sewage pipeline connected to the water container. While avoiding the discharge of filtered impurities with the drainage, it also effectively prevents the recovery device from overflowing.

7. The washing machine can control the suction device to automatically turn off when the certain conditions are reached during performing the suction action, stopping the discharge of sewage, so as to control the amount of sewage discharged from the filtering device at one time, avoid overflow of the sewage temporary storage device, and thus prevent the problem of sewage overflowing into the suction device.

8. The water from the water container first passes through the filtering device to filter out the filtered impurities in the water before being discharged from the washing machine, further avoiding the presence of filtered impurities in the drainage water flow, thereby ensuring to the greatest extent that no filtered impurities are directly discharged from the washing machine, and avoiding the microplastics in the filtered impurities from being discharged into the ecological cycle with the water flow.

The specific implementation modes of the present disclosure are further described in detail below in conjunction with the accompanying drawings.

BRIEF DESCRIPTION OF THE DRAWINGS

The accompanying drawings are part of the present disclosure and are used to provide a further understanding of the present disclosure. The exemplary embodiments of the present disclosure and their descriptions are used to explain the present disclosure, but do not constitute an improper limitation of the present disclosure. Obviously, the drawings described below are only some embodiments. For those skilled in art, other drawings can be obtained based on these drawings without creative work. In the drawings.

Figure 1:
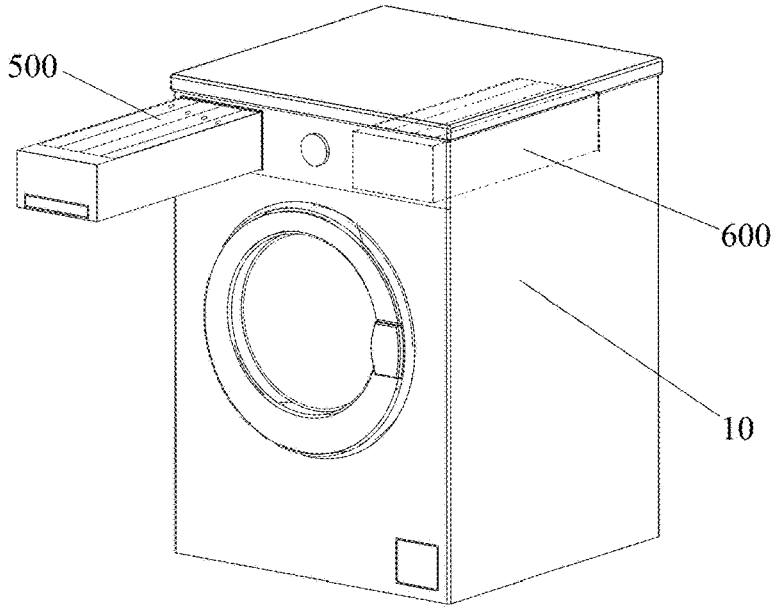
FIG. 1 is a schematic structural diagram of a washing machine according to an embodiment of the present disclosure.

In the figure: 10. box body; 100. water container; 110. window pad; 210. drainage pipeline; 220. circulation pipeline; 230. return water pipeline; 240. sewage pipeline; 241. sewage valve; 250. discharge pipeline; 251. control valve; 260. water container drainage pipe; 270. switching device; 300. water inlet box; 310. water inlet pipe; 400. delivery pump; 500. recovery device; 510. housing; 520. filter component; 531. first chamber; 532. second chamber; 540. blocking member; 541. base body; 542. opening portion; 550. sewage inlet; 551. tubular portion; 552. connecting portion; 600. filtering device; 610. filtering cavity; 6101. water inlet; 6102. filtered water outlet; 6103. sewage outlet; 620. filtering mechanism; 621. water outlet joint; 660. driving mechanism; 680. cleaning particles; 690. baffle;

701. water inlet; 702. circulating water outlet; 703. drainage outlet; 704. sewage inlet; 705. sewage outlet; 711. first valve body; 712. switching mechanism; 713. first motor; 721. second valve body; 722. blocking mechanism; 723. second motor; 810. air pump; 811. suction pipeline; 820. sewage temporary storage device; 821. air hole; 822. float ball; 823. guiding part; 824. water level detection device; 830. buffer portion; 831. ventilation pipeline; 832. air vent.

It should be noted that these drawings and textual descriptions are not intended to limit the conceptual scope of the present disclosure in any way, but are intended to illustrate the concept of the present disclosure for those skilled in the art by referring to specific embodiments.

DETAILED DESCRIPTION

In order to make the purpose, technical solutions and advantages of the embodiments of the present disclosure clearer, the technical solutions in the embodiments will be clearly and completely described below in conjunction with the drawings in the embodiments of the present disclosure. The following embodiments are used to illustrate the present disclosure but are not used to limit the scope of the present disclosure.

In the description of the present disclosure, it should be noted that the directions or positional relationships indicated by terms such as "upper", "lower", "front", "back", "left", "right", "vertical", "inside" and "outside" are based on the directions or positional relationships shown in the accompanying drawings, and are only for the convenience of describing the present disclosure and simplifying the description, rather than indicating or implying that the device or element referred to must have a specific direction, be constructed and operated in a specific direction, and therefore cannot be understood as a limitation on the present disclosure.

In the description of the present disclosure, it should be noted that, unless otherwise clearly specified and limited, the terms "installed", "connected", and "connected" should be understood in a broad sense, for example, it can be a fixed connection, a detachable connection, or an integral connection; it can be a mechanical connection or an electrical connection; it can be a direct connection or an indirect connection through an intermediate medium. For ordinary technicians in this field, the specific meanings of the above terms in the present disclosure can be understood according to specific circumstances.

Embodiment 1

Figure 2:
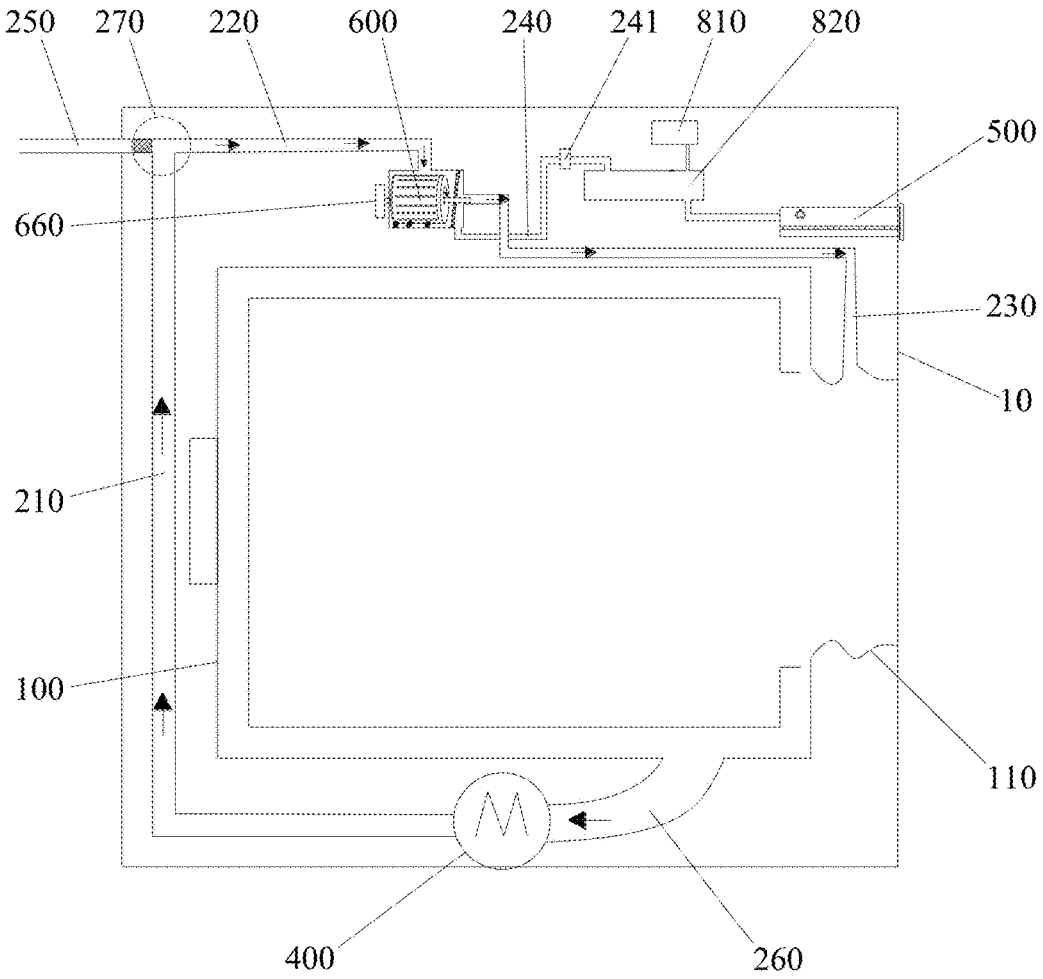
FIG. 2 is a schematic diagram of the internal structure of a washing machine in Embodiment 1 of the present disclosure.
Figure 3:
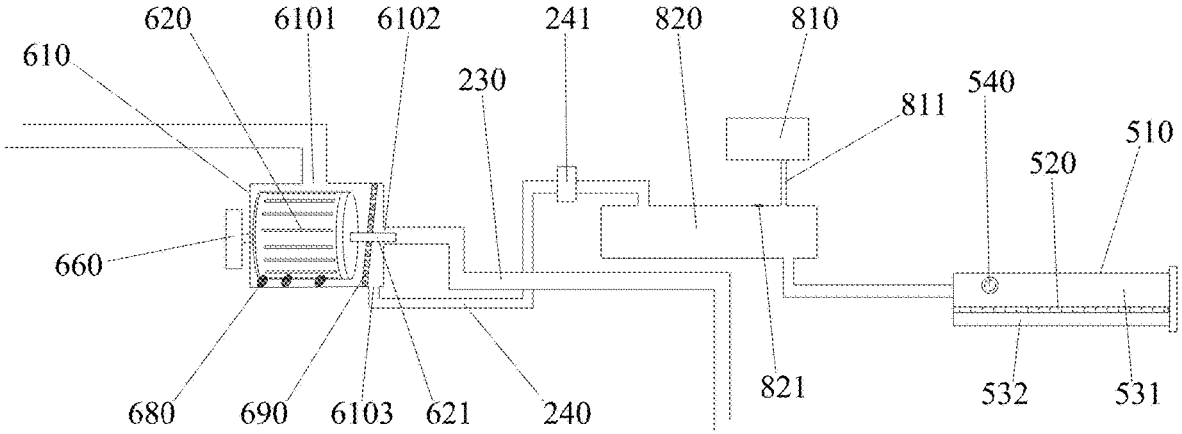
FIG. 3 is a schematic diagram of the communication structure between the filtering device and the recovery device in Embodiment 1 of the present disclosure.

As shown in FIGS. 1 to 3, this embodiment provides a washing machine, comprising:

a water container 100;

a filtering device 600 is connected to the water container 100, receiving water in the water container 100 for filtering, and is provided with a sewage outlet 6103 for discharging sewage to the outside;

a recovery device 500 for collecting the sewage discharged by the filtering device 600.

In this embodiment, the washing machine is provided with a circulating filtration pipeline whose two ends are respectively connected to the water container 100, and the filtering device 600 is provided on the circulating filtration pipeline. The circulating filtration pipeline is also provided with a delivery pump 400, which drives the water in the water container 100 to circulate continuously through the circulating filtration pipeline through the delivery pump 400, and the filaments and other filter impurities can be removed when passing through the filtering device 600, thereby reducing the lint content in the water and improving the washing effect of the clothes.

The filtering device 600 is provided with a sewage outlet 6103. The filtered impurities remaining in the filtering device 600 after filtering can be discharged from the sewage outlet 6103 with the water flow, without the need for the user to take out the filtering device 600 for manual cleaning, which is more convenient to use. The recovery device 500 is connected to the sewage outlet 6103 of the filtering device 600. After the sewage carrying the filtered impurities is discharged from the sewage outlet 6103, it can enter the recovery device 500 to be collected, and will not be merged into the drainage water flow to be discharged from the washing machine. The above method prevents the microplastics in the filtered impurities from being discharged with the water flow and entering the ecological cycle, thereby avoiding causing harm to the ecological environment and human health.

Due to the limitation of the internal space of the washing machine, the distance between the filtering device 600 and the recovery device 500 may be relatively long, resulting in a relatively long path for the sewage to be discharged into the recovery device 500. As shown in FIG. 1, in this embodiment, the recovery device 500 and the filtering device 600 are respectively arranged on the left and right sides of the top of the box body 10 of the washing machine. Without the help of external force, it is difficult for the sewage in the filtering device 600 to be completely discharged into the recovery device 500. If the height of the recovery device 500 is higher than the sewage outlet 6103 of the filtering device 600, the sewage may even be unable to be discharged.

A conventional water pump is generally used in a washing machine to provide power to drive the water flow. However, since the filtering device 600 discharges sewage carrying filtered impurities into the recovery device 500, using a conventional pumping method, the sewage may be blocked when passing through the water pump body, thereby causing the washing machine to malfunction.

In order to solve the problem that the filtering device 600 discharges sewage into the recovery device 500, a suction device is provided in the washing machine of this embodiment, and the suction device can perform a suction action to suck the air in the space outside the sewage outlet 6103, thereby driving the sewage in the filtering device 600 to be discharged into the recovery device 500 through the sewage outlet 6103 under the action of the pressure difference.

In this embodiment, an air pump 810 is used as a suction device. Specifically, when the filtering device 600 needs to discharge sewage, the air pump 810 is controlled to perform a suction action, and the air in the space outside the sewage outlet 6103 is sucked out by the air pump 810, so that the pipeline outside the sewage outlet 6103 forms a negative pressure environment, and the sewage in the filtering device 600 can be discharged under the action of the pressure difference and finally discharged into the recovery device 500.

Through the above method, the sewage in the filtering device 600 can be efficiently and quickly discharged into the recovery device 500 for collection. At the same time, the air pump 810 is only used to suck air to form a negative pressure environment, and the discharged sewage does not pass through the air pump 810, avoiding the problem of water pump transportation easily causing pump blockage.

In this embodiment, the air pump 810 is connected to the sewage outlet 6103 of the filtering device 600 and the recovery device 500 through the suction pipeline 811, and performs the suction action according to the instruction. The instruction is the instruction to control the filtering device 600 to discharge sewage.

Furthermore, the sewage outlet 6103 of the filtering device 600 is connected to a sewage temporary storage device 820 having an internal cavity, the sewage temporary storage device 820 is connected to the recovery device 500, and the suction pipeline 811 is connected to the internal cavity of the sewage temporary storage device 820.

When the filtering device 600 discharges sewage, the washing machine performs the following steps:

S1, controlling the air pump 810 to perform a suction action, the air in the sewage temporary storage device 820 is sucked out by the air pump 810, and the sewage in the filtering device 600 is discharged into the sewage temporary storage device 820 under the action of the pressure difference;

S2, turning off the air pump 810, the suction effect of the air pump 810 disappears, and the sewage in the sewage temporary storage device 820 is discharged into the recovery device 500.

In the above scheme, by providing the sewage temporary storage device 820, after the sewage is extracted from the filtering device 600 under the action of the pressure difference, it can be temporarily stored in the internal chamber of the sewage temporary storage device 820. This avoids the situation where the sewage flows out of the filtering device 600 quickly and enters the air pump 810 along the suction pipeline 811 due to the large suction force of the air pump 810, thereby protecting the air pump 810 and preventing the working performance of the air pump 810 from being affected.

Preferably, a first vent hole is provided on the top of the temporary sewage storage device 820 to communicate with the suction pipeline 811. The suction pipeline 811 is connected to the top area of the temporary sewage storage device 820, and the sewage can enter the suction pipeline 811 only when the internal cavity is filled with sewage. In this way, the internal cavity of the temporary sewage storage device 820 can be used to the maximum extent, and the amount of sewage that the temporary sewage storage device 820 can accommodate is increased.

In this embodiment, the water outlet of the sewage temporary storage device 820 is higher than the sewage inlet of the recovery device 500. After the air pump 810 is turned off and stops pumping, the sewage in the sewage temporary storage device 820 is discharged into the recovery device 500 under the action of gravity.

In the preferred solution of this embodiment, an air hole 821 is provided on the sewage temporary storage device 820 for connecting the internal volume of the sewage temporary storage device 820 with the external space. After the air pump 810 is turned off, the external air enters the internal volume of the sewage temporary storage device 820 through the air hole 821, driving the sewage therein to be discharged into the recovery device 500. The air hole 821 is similar to the first vent hole for connecting the suction pipeline 811, and is also provided in the top area of the sewage temporary storage device 820.

In the above scheme, the opening area of the air hole 821 is relatively small. When the air pump 810 is turned on to perform the suction action, the air entering the sewage temporary storage device 820 through the air hole 821 will not have a significant impact on the formation of the negative pressure environment. After the air pump 810 is turned off, the air in the sewage temporary storage device 820 is no longer extracted. Due to the setting of the air hole 821, the interior of the sewage temporary storage device 820 can quickly return to a pressure close to atmospheric pressure, and the entry of air pushes the sewage to be discharged into the recovery device 500. By providing the air hole 821 on the sewage temporary storage device 820, it is avoided that the air pressure in the recovery device 500 is too high, and the sewage cannot flow into the recovery device 500 after the air pump 810 stops working.

On the other hand, a one-way valve or similar structure may be installed on the air hole 821 to control the air hole 821 to conduct one-way from outside to inside, thereby preventing sewage from overflowing from the air hole 821 after the sewage temporary storage device 820 is filled with water.

In this embodiment, the air pump 810 is a bidirectional pump, which can perform a suction action to realize the function of sucking air, and can also perform an air-inflating action to pass air into the sewage temporary storage device 820. In the above step S2, the air pump 810 is first turned off to stop sucking air, and then the air pump 810 is turned on again and controlled to perform an air-inflating action to pass air into the sewage temporary storage device 820, driving the sewage therein to be discharged into the recovery device 500.

In another solution of this embodiment, the air pump 810 is a vacuum pump having only a suction function. The washing machine further includes an inflating device (not shown in the figure) connected to the sewage temporary storage device, such as an air pump. In the above solution, step S2 includes: turning off the air pump 810, turning on the inflating device, introducing air into the sewage temporary storage device 820, and driving the sewage therein to be discharged into the recovery device 500.

In a further solution of this embodiment, an openable/closable sewage valve 241 is provided between the sewage outlet 6103 of the filtering device 600 and the suction inlet end of the suction pipeline 811. Specifically, the sewage valve 241 is provided between the filtering device 600 and the sewage temporary storage device 820.

In detail, the sewage outlet 6103 is connected to the sewage temporary storage device 820 through the sewage pipeline 240, and the sewage valve 241 is arranged on the sewage pipeline 240 to control the on-off of the sewage pipeline 240.

When the delivery pump 400 drives the water in the water container 100 to circulate and filter, the sewage valve 241 is closed and the sewage pipeline 240 is disconnected. When it is necessary to discharge the sewage in the filtering device 600, the washing machine performs the following steps in sequence:

S11, controlling the air pump 810 to perform a suction action, and the air in the sewage temporary storage device 820 is sucked out;

S12, opening the sewage valve 241, connecting the sewage pipeline 240, and the sewage in the filtering device 600 is discharged into the sewage temporary storage device 820 under the action of the pressure difference;

S2, turning off the air pump 810, and discharging the sewage in the sewage temporary storage device 820 into the recovery device 500.

In the above scheme, the sewage valve 241 is kept closed at the beginning of the suction action of the air pump 810, and the filtering device 600 is not connected to the sewage temporary storage device 820, so that a more obvious negative pressure environment can be formed more quickly in the sewage temporary storage device 820. Then, the sewage valve 241 is opened, and the sewage in the filtering device 600 can be subjected to a greater driving force, so that it can be efficiently and fully discharged into the sewage temporary storage device 820.

In a further solution of this embodiment, the recovery device 500 specifically includes:

a housing 510 with a recovery chamber therein;

a filter component 520, being disposed in the recovery chamber, and divides the recovery chamber into a first chamber 531 and a second chamber 532.

The sewage temporary storage device 820 is connected to the first chamber 531. The sewage carrying filtered impurities enters the first chamber 531, and enters the second chamber 532 after being filtered by the filter component 520. The filtered impurities are collected in the first chamber 531.

In the above solution, after the recovery device 500 collects the sewage discharged by the filtering device 600, it can also filter the sewage through the internal filtering component 520 to separate the filtered impurities in the sewage. In this way, the user can directly collect and process the separated filtered impurities, avoiding the situation where the filtered impurities are mixed in the sewage and cannot be effectively processed.

Specifically, the filter component 520 may be a frame horizontally arranged at a certain height in the recovery chamber and a filter screen laid on the frame, and the filter component 520 forms a first chamber 531 on the upper side and a second chamber 532 on the lower side. After the sewage carrying the filtered impurities enters the first chamber 531, the water can enter the second chamber 532 through the filter component 520, and the filtered impurities are blocked by the filter screen and remain on the upper surface of the filter component 520.

Among them, the filter screen of the filter component 520 can filter microplastics in sewage and prevent microplastics from mixing into the water body.

In this embodiment, the recovery device 500 is insertably/removably disposed on the box body 10 of the washing machine, and the user can remove the recovery device 500 from the box body 10 for cleaning.

Specifically, the housing 510 of the recovery device 500 is insertable/removable and is disposed on the box body 10, and the upper side of the housing 510 has an opening. When the user removes the housing 510 from the box body 10, the filtered impurities attached to the upper surface of the filter component 520 can be cleaned through the opening on the upper side of the housing 510. The filter component 520 is preferably detachably connected to the housing 510, and the user can remove the filter component 520 from the inside of the housing 510 and take it out for cleaning, which is more convenient to operate.

In the preferred solution of this embodiment, a water outlet is provided on the second chamber 532 for discharging the filtered clean water. By providing the water outlet on the second chamber 532, the clean water entering the second chamber 532 can be discharged from the recovery device 500 in time, so as to avoid overflow of the recovery device 500 when the amount of sewage discharged by the filtering device 600 is large. Otherwise, the capacity of the second chamber 532 needs to be increased, that is, the volume of the recovery device 500 needs to be increased, resulting in it occupying a large space inside the washing machine, which is not conducive to the miniaturization of the overall volume of the washing machine.

On the other hand, the water in the second chamber 532 can be automatically discharged from the water outlet. When the user cleans the recovery device 500, he only needs to clean the filtered impurities on the filter component 520 without manually pouring out the clean water in the second chamber 532. When the filter component 520 is detachably installed in the housing 510, the user does not even need to completely remove the housing 510 from the box body 10 of the washing machine, but only needs to take out the filter component 520 for cleaning, which is more convenient to operate.

Preferably, the water outlet of the second chamber 532 is connected to the water container 100 through a pipeline, and the clean water filtered by the filter component 520 can be passed into the water container 100 for reuse, thereby saving the water consumption of the washing machine. Alternatively, the water outlet of the second chamber 532 can be connected to the outside of the washing machine through a pipeline, and the filtered water without filtered impurities can be directly discharged from the washing machine, which will not cause the problem of microplastics entering the ecological cycle.

In this embodiment, the filtering device 600 specifically includes:

a filtering cavity 610, being provided with a water inlet 6101, a filtered water outlet 6102 and a sewage outlet 6103, and the water inlet 6101 and the filtered water outlet 6102 are connected to the circulating filtration pipeline;

a filtering mechanism 620, being rotatably disposed in the filtering cavity 610;

a driving mechanism 660 driving the filtering mechanism 620 to rotate in the filtering cavity 610.

The filtering mechanism 620 includes a filter holder and a filter screen covering the surface of the filter holder, which divides the interior of the filtering cavity 610 into an outer chamber and an inner chamber. The water in the water container 100 enters the outer chamber of the filtering cavity 610 through the water inlet 6101. The filtered impurities in the water are blocked by the filter screen and adhere to the outer surface of the filtering mechanism 620. The clean water without filtered impurities enters the inner chamber and passes through the water outlet joint 621 connected with the inner chamber, and finally flows out of the filtering cavity 610 from the filtered water outlet 6102. By designing the pore size of the filter, the filtering mechanism 620 can not only filter large-sized lint in the water, but also filter microplastics in the water, thereby significantly reducing the content of microplastics in the drainage of the washing machine.

When the filtering device 600 needs to be cleaned, the filtering mechanism 620 is driven to rotate in the filtering cavity 610 through the driving mechanism 660, such as a motor, to stir the residual water in the filtering cavity 610, so that the filtered impurities attached to the surface of the filtering mechanism 620 are peeled off from the filtering mechanism 620 under the action of centrifugal force and agitated water flow, and merged into the water in the filtering cavity 610. Finally, the sewage can be discharged from the sewage outlet 6103 through the action of the air pump 810 and collected by the recovery device 500.

In this embodiment, the self-cleaning operation of turning on the driving mechanism 660 to rotate the filtering mechanism 620 and/or the sewage discharge operation of controlling the air pump 810 to perform a suction action to discharge sewage from the filtering device 600 is performed at least once during a complete washing cycle of the washing machine. When performing the sewage discharge operation, the filtering mechanism 620 can remain stationary or be driven to rotate by the driving mechanism 660.

Furthermore, cleaning particles 680 are also provided in the filtering cavity 610 of the filtering device 600, which are used to clean the inner wall of the filtering cavity 610 and the outer wall of the filtering mechanism 620 by friction and collision with the water flow. During the circulating filtration process, the cleaning particles 680 continuously rub the inner wall of the filtering cavity 610 and the outer wall of the filtering mechanism 620 with the flowing water flow, so that the attached filter impurities fall off, thereby preventing the deposition of filter impurities and avoiding the filtering mechanism 620 from being covered by filter impurities, which affects the filtration efficiency. When the filtering mechanism 620 rotates for self-cleaning, the cleaning particles 680 move in the filtering cavity 610 with the action of the agitated water flow, and rub against the inner wall of the filtering cavity 610 and the outer wall of the filtering mechanism 620, thereby improving the stripping efficiency of filter impurities, and the self-cleaning effect of the filtering device 600 is better.

A baffle 690 is also provided in the filtering cavity 610 to divide the interior of the filtering cavity 610 into a first space on the left and a second space on the right. The cleaning particles 680 and the main part of the filtering mechanism 620 are both located in the first space. The water inlet 6101 is connected to the first space, and the filtered water outlet 6102 and the sewage outlet 6103 are connected to the second space. The baffle 690 is provided with a water hole connecting the first space and the second space. The sewage in the filtering cavity 610 can be discharged from the sewage outlet 6103 through the baffle 690. The cleaning particles 680 cannot pass through the water hole and are blocked on the left by the baffle 690, thereby preventing the cleaning particles 680 from being discharged with the sewage through the sewage outlet 6103 or accumulating at the sewage outlet 6103 to cause blockage.

The circulating filtration pipeline of the washing machine in this embodiment specifically includes:

- a water container drainage pipewater container drainage pipe 260 connects the water container 100 and the water inlet end of the delivery pump 400;
- a drainage pipeline 210, one end of which is connected to the water outlet of the delivery pump 400, and the other end of which is connected to the switching device 270;
- a circulation pipeline 220 has one end connected to the switching device 270 and the other end connected to the water inlet 6101 of the filtering device 600;
- a return water pipeline 230 has one end connected to the filtered water outlet 6102 of the filtering device 600 and the other end connected to the water container 100 to transport the filtered water to the water container 100.

The switching device 270 is also connected to the discharge pipeline 250 for draining water to the outside of the washing machine, and the switching device 270 can control the circulation pipe 220 and the discharge pipeline 250 to be connected to the drainage pipeline 210. In this way, the delivery pump 400 can provide driving force for the circulation filtration and drainage of the washing machine, and the corresponding functions can be realized by controlling the conduction direction of the switching device 270.

The water outlet end of the return water pipe 230 is connected to the window pad 110 at the opening of the water container 100, and the water filtered by the filtering device 600 enters the window pad 110 and returns to the water container 100.

In this embodiment, the recovery device 500 is provided in the washing machine to collect the sewage discharged from the filtering device 600, so as to prevent the sewage carrying the filtered impurities from being directly discharged from the washing machine, causing the microplastics in the filtered impurities to enter the ecological cycle and affect the ecological environment and human health. A filter component 520 is provided in the recovery device 500 to filter the collected sewage, thereby separating the filtered impurities from the water, which is convenient for cleaning the filtered impurities.

The air pump 810 is provided in the washing machine to draw air between the filtering device 600 and the recovery device 500, so that a negative pressure environment is formed outside the sewage outlet 6103, and the sewage in the filtering device 600 is driven to be discharged from the sewage outlet 6103 into the recovery device 500 through the pressure difference. Even if the filtering device 600 and the recovery device 500 are far apart or there is a height difference, the sewage in the filtering device 600 can be fully discharged. A sewage temporary storage device 820 is provided between the filtering device 600 and the recovery device 500 and is directly connected to the air pump 810, so as to prevent the air pump 810 from sucking in sewage when drawing air. Compared with the traditional water pump driving method, the air pump 810 draws air to drive the sewage to be discharged, which avoids the problem of the water pump being blocked by the filtered impurities in the sewage, and the sewage is discharged more smoothly.

Embodiment 2

Figure 4:
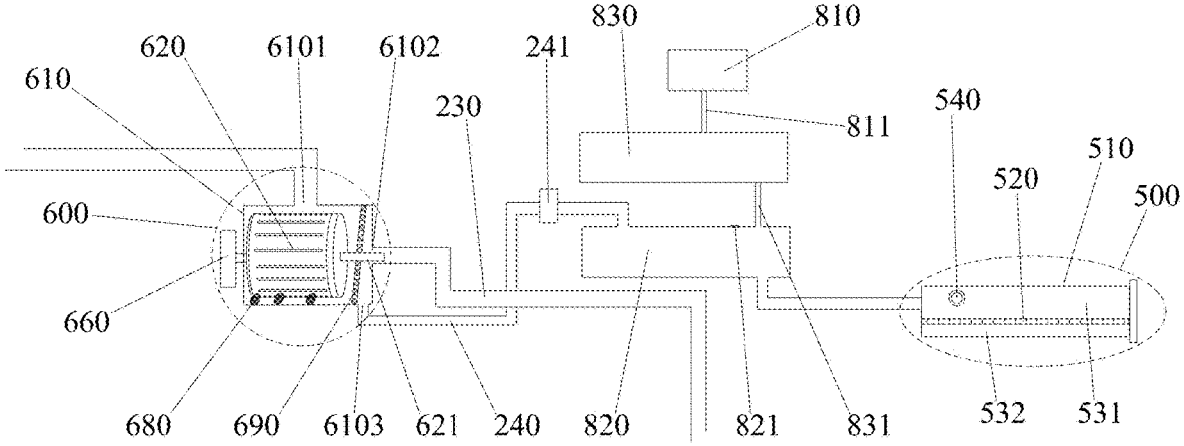
FIG. 4 is a schematic diagram of the connection structure between the filtering device and the recovery device in the Embodiment 2 of the present disclosure.
Figure 5:
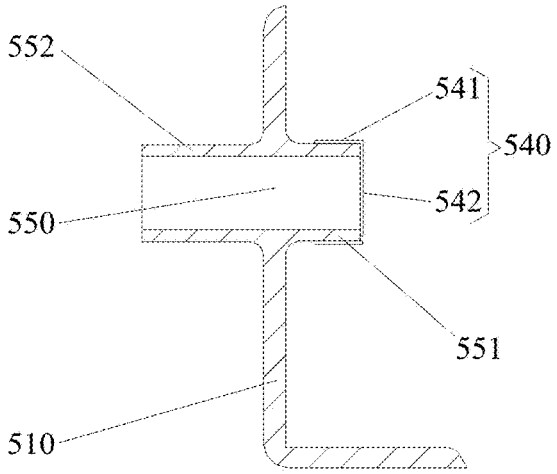
FIG. 5 is a partial enlarged view of the sewage inlet of the recovery device in the Embodiment 3 of the present disclosure (normal state)
Figure 6:
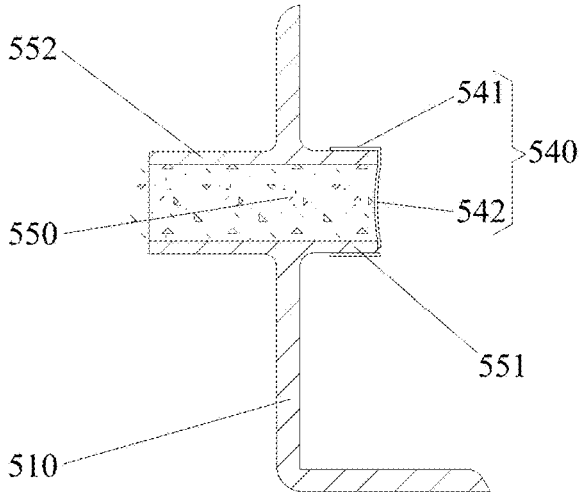
FIG. 6 is a partial enlarged view of the sewage inlet of the recovery device in the Embodiment 3 of the present disclosure (blocked state when the air pump is turned on)
Figure 7:
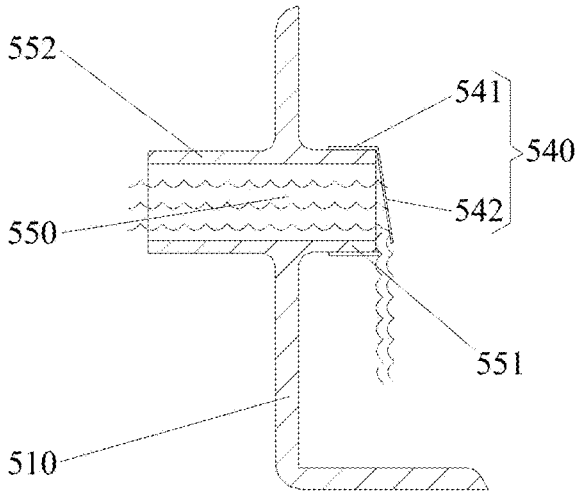
FIG. 7 is a partial enlarged view of the sewage inlet of the recovery device in the Embodiment 3 of the present disclosure (open state after the air pump is turned off)
Figure 8:
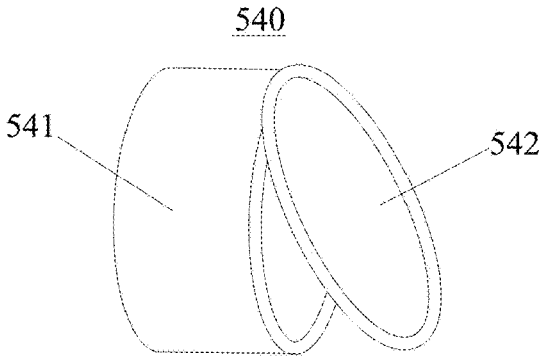
FIG. 8 is a schematic structural diagram of a blocking member in Embodiment 3 of the present disclosure.

As shown in FIG. 4, this embodiment is a further limitation of the above-mentioned embodiment 1, wherein a buffer portion 830 is provided between the air pump 810 and the sewage temporary storage device 820, and a buffer chamber is provided inside the buffer portion 830. The buffer chamber is communicated with the internal chamber of the sewage temporary storage device 820 through the first vent hole, and the suction pipeline 811 is connected to the buffer portion 830, conducting the air pump 810 and the buffer chamber, and the air pump 810 sucks the air in the sewage temporary storage device 820 through the buffer portion 830.

In the above scheme, after the air pump 810 is turned on, it can suck the inside of the buffer portion 830 and the sewage temporary storage device 820 to form a negative pressure state, and then after the sewage discharge control valve 241 is opened, the sewage in the filtering device 600 can be quickly discharged under the pressure difference. By arranging the buffer portion 830 between the air pump 810 and the sewage temporary storage device 820, even if the amount of discharged sewage is large and overflows from the sewage temporary storage device 820, part of the overflowed sewage can be stored in the buffer chamber of the buffer portion 830, and will not directly enter the air pump 810.

In the preferred solution of this embodiment, the buffer portion 830 is arranged above the sewage temporary storage device 820, and the first vent hole of the sewage temporary storage device 820 is connected to the ventilation pipeline 831, and the ventilation pipeline 831 extends vertically upward to communicate with the buffer chamber of the buffer portion 830. Further, the air pump 810 is arranged above the buffer portion 830, and the top wall of the buffer portion 830 is provided with a second vent hole connected to the air pump 810. The second vent hole of the buffer portion 830 is connected to the suction pipeline 811, and the suction pipeline 811 extends vertically upward to connect to the air inlet end of the air pump 810.

Through the above structure, the sewage enters the upper buffer portion 830 and the air pump 810 from the sewage temporary storage device 820 under the suction action of the air pump 810, and the suction force required is greater, which further prevents the air pump 810 from entering water.

In this embodiment, by providing the buffer portion 830 between the air pump 810 and the temporary sewage storage device 820, the sewage overflowing from the temporary sewage storage device 820 can be stored to prevent the excessive amount of sewage from entering the air pump 810. The temporary sewage storage device 820, the ventilation pipeline 831, the buffer portion 830, the suction pipeline 811 and the air pump 810 are provided in sequence from bottom to top, which increases the height required for the sewage to rise to enter the air pump 810, thereby requiring a greater suction force, thereby more effectively preventing the air pump 810 from entering water.

Embodiment 3

As shown in FIG. 3 to FIG. 8, this embodiment is a further limitation of the above-mentioned embodiment 1 or 2, and a blocking member 540 that conducts one-way from outside to inside is provided at the sewage inlet 550 of the recovery device 500.

When the air pump 810 performs the suction action, the blocking member 540 can block the sewage inlet 550 of the recovery device 500, so that the air in the recovery device 500 cannot be sucked out from the sewage inlet 550, and then the space between the sewage outlet 6103 and the recovery device 500 is relatively independent. In this way, under the suction action of the air pump 810, a negative pressure environment can be quickly formed outside the sewage outlet 6103, thereby improving the efficiency of sewage discharge. After the air pump 810 is turned off, the suction effect disappears, and the sewage flows to the outside of the sewage temporary storage device 820 due to the gravity or the increase in air pressure generated by the air entering the sewage temporary storage device 820. The blocking member 540 can open the sewage inlet 550 under the action of water pressure, and the sewage enters the recovery device 500 and is collected.

Specifically, the blocking member 540 includes:

- a base body 541 is mounted on the sewage inlet 550 of the recovery device 500;
- an opening portion 542 and the base body 541 can move relative to each other to open/close the space outside and inside the recovery device 500.

Furthermore, the sewage inlet 550 is provided on the housing 510 of the recovery device 500, and the outer periphery of the sewage inlet 550 extends a certain length from the inner wall of the housing 510 of the recovery device 500 to the inside of the recovery device 500 to form a tubular portion 551. The base body 541 is installed at the extended end of the tubular portion 551, and the opening portion 542 is relatively movable with the extended end of the tubular portion 551 to open/block the opening of the extended end of the tubular portion 551.

In detail, the base body 541 is sleeved on the extended end of the tubular portion 551, the opening portion 542 covers the opening of the tubular portion 551 from the outside of the tubular portion 551 to achieve blocking, and the opening portion 542 flips in a direction away from the tubular portion 551 to open the opening. The blocking member 540 has a simple structure, and the opening portion 542 abuts against the right end surface of the tubular portion 551 and cannot flip inward toward the inside of the tubular portion 551, thereby achieving unidirectional conduction of the sewage inlet 550 from outside to inside.

In one solution of this embodiment, the opening portion 542 is made of a flexible material that can undergo elastic deformation, such as rubber. When the air pump 810 is turned on, the portion of the opening portion 542 covering the opening is deformed to bulge toward the inside of the tubular portion 551, thereby sealing the opening. The opening portion 542 can wrap the angle between the inner wall of the tubular portion 551 and the right end face of the tubular portion 551 to a certain extent, thereby increasing the contact area between the opening portion 542 and the opening of the tubular portion 551. At the same time, the surface of the opening portion 542 facing the tubular portion 551 forms a convex surface, and the surface area increases, that is, the force area of the opening portion 542 subjected to the negative pressure adsorption force is increased, and then the sewage inlet 550 can be better sealed through the blocking member 540, which is conducive to the rapid formation of a negative pressure environment.

Furthermore, the opening portion 542 and the base body 541 are integrally formed, that is, the blocking member 540 is made of a flexible material as a whole. No additional connecting structure is required between the base body 541 and the opening portion 542, so that the opening portion 542 and the base body 541 can be relatively movable, thereby opening/blocking the opening at the right end of the tubular portion 551 through the movement of the opening portion 542.

In another solution of this embodiment, the opening portion of the blocking member is made of a hard material, and the surface of the opening portion facing the opening of the tubular portion is a convex surface protruding toward the inside of the tubular portion. Specifically, the opening of the tubular portion is circular, the opening portion is a disc-shaped structure, and the surface of the opening portion facing the opening of the tubular portion is a convex surface with a central protrusion.

When the opening portion blocks the opening of the tubular portion, the opening portion has a curved surface and can partially extend into the opening, and the surface in contact with the opening of the tubular portion is relatively inclined to the end surface of the tubular portion, so that the opening can be more firmly blocked and have a better sealing effect. At the same time, the curved surface structure of the opening portion increases the surface area, that is, increases the force area of the opening portion that is subjected to the suction force of the air pump, which can further enhance the sealing performance, thereby better forming a negative pressure environment between the sewage outlet of the filtering device and the recovery device.

In a further aspect, the opening portion of the blocking member is separately provided with the base body, and the two are relatively movably connected. Specifically, the opening portion and the base body are rotatably connected, and the opening portion realizes opening/blocking of the tubular portion opening by a turning motion.

Alternatively, the opening portion and the base body can also be integrally formed of plastic, wherein both the opening portion and the base body are hard and will not deform significantly. The opening portion and the base body are connected by a thin connecting piece, which is thin and can deform under a small force, so that the opening portion and the base body can move relative to each other.

In a further solution of this embodiment, the outer periphery of the sewage inlet 550 extends a certain length from the outer wall of the housing 510 of the recovery device 500 to the outside of the recovery device 500 to form a connecting portion 552, and the connecting portion 552 is used to connect with the pipeline and communicate with the sewage temporary storage device 820 through the pipeline. The end of the pipeline can be sleeved on the connecting portion 552, which is more convenient for installation.

In this embodiment, a one-way blocking member 540 is provided at the sewage inlet 550 of the recovery device 500. The blocking member 540 can seal the sewage inlet 550 of the recovery device 500 when the air pump 810 draws air, thereby forming a negative pressure environment more quickly and increasing the pressure difference that can be formed by the sewage outlet 6103, thereby improving the efficiency of the filtering device 600 in discharging sewage. After the air pump 810 is turned off, the blocking member 540 can automatically open the sewage inlet 550 under the impact of the water flow, so that the sewage can smoothly enter the recovery device 500 and be collected.

Embodiment 4

The different between this embodiment and embodiment 3 is that the blocking member is arranged on the water outlet of the recovery device and conducts water from the inside of the recovery device to the outside in a one-way manner.

Specifically, when the air pump is turned on, the blocking member seals the water outlet of the recovery device, and external air cannot enter, so that a negative pressure environment is formed inside the buffer portion, the sewage temporary storage device, and the recovery device. The sewage in the filtering device is discharged under the action of the pressure difference, and most of it is stored in the sewage temporary storage device, and a small part may directly enter the recovery device. However, the sewage blocks the pipeline between the sewage temporary storage device and the recovery device, so that the air in the recovery device can no longer be further extracted.

When the air pump is turned off, the sewage temporary storage device can be restored to a pressure close to atmospheric pressure, and the recovery device still has a certain negative pressure inside, and the sewage in the sewage temporary storage device can be discharged into the recovery device. At the same time, when the sewage enters the recovery device, the blocking part can open the water outlet, so that the air inside the recovery device can be discharged from the water outlet along with the sewage, ensuring that the sewage enters the recovery device smoothly.

Embodiment 5

As shown in FIG. 4, this embodiment is a further limitation of the above-mentioned embodiment 2. The suction device (i.e., the air pump 810) performs a suction action to discharge all the sewage retained in the filtering device 600 into the sewage temporary storage device 820.

In this embodiment, the washing machine further includes a detection device for detecting the discharge of sewage in the filtering device 600. The air pump 810 stops the suction action when the detection device detects that the sewage in the filtering device 600 is completely discharged. The air pump 810 can completely pump out the sewage in the filtering device 600 by performing a single suction action, thereby achieving efficient discharge of sewage.

Specifically, the detection device can be a water level gauge provided on the filtering device 600, which determines whether the sewage is completely discharged by detecting the water level in the filtering device 600. When the water level in the filtering device 600 fed back by the water level gauge is zero, the air pump 810 is controlled to be turned off to stop the suction action.

Alternatively, the detection device is a flow meter arranged on the sewage pipeline 240. During the suction action of the air pump 810, if the flow meter detects that the flow in the sewage pipeline 240 is continuously zero, it is determined that the sewage in the filtering device 600 has been completely discharged, and the air pump 810 is controlled to be closed to stop the suction action.

Alternatively, the detection device may collect images of the interior of the filtering device 600 and determine whether the sewage is completely discharged based on the collected images. When the washing machine determines that the sewage is completely discharged based on the collected images of the interior of the filtering device 600, the air pump 810 is controlled to be turned off to stop the suction action.

In a further solution of this embodiment, the amount of sewage that can be accommodated between the sewage outlet 6103 of the filtering device 600 and the sewage inlet of the recovery device 500 is greater than or equal to the maximum amount of sewage that can be accommodated by the filtering device 600. Specifically, the sewage outlet 6103 of the filtering device 600 is connected to the sewage temporary storage device 820 through the sewage pipeline 240, and the sewage temporary storage device 820 is connected to the recovery device 500 through the connecting pipe 825, and the total volume of the sewage pipeline 240, the connecting pipe 825 and the sewage temporary storage device 820 is not less than the volume of the filtering device 600.

The above structure ensures that when the air pump 810 performs a suction action to completely discharge the sewage in the filtering device 600, the discharged sewage will not overflow from the sewage temporary storage device 820 and flow into the air pump 810 before entering the recovery device 500, thereby preventing the sewage from entering the air pump 810.

In the preferred solution of this embodiment, the volume of the sewage temporary storage device 820 is set to be larger than the volume of the filtering device 600, or at least larger than the maximum amount of sewage that can be stored in the filtering device 600, so that when the sewage in the filtering device 600 is discharged at one time, the sewage temporary storage device 820 will not be filled. This further avoids the situation where the sewage overflows the sewage temporary storage device 820 and enters the air pump 810 when the filtering device 600 discharges sewage into the sewage temporary storage device 820, thereby protecting the air pump 810.

Embodiment 6

As shown in FIGS. 9 to 12, this embodiment is a further limitation of any of the above embodiments, and the washing machine further comprises an isolation mechanism disposed between the sewage outlet 6103 and the suction device (i.e., the air pump 810), and the isolation mechanism can gradually disconnect the connection between the air pump 810 and the sewage outlet 6103 as the sewage is discharged, so as to prevent the sewage from being sucked into the air pump 810 when the amount of sewage discharged from the sewage outlet 6103 is too large when the air pump 810 continues to suck. In this way, the air pump 810 can be protected, and sewage can be prevented from entering the air pump 810 and affecting its working performance.

In the specific solution of this embodiment, the isolation mechanism includes a floating member, and an air vent 832 is provided on the communication path between the air pump 810 and the sewage outlet 6103. During the sewage discharge process, the floating member rises with the water surface to below the air vent 832 to block the air vent 832.

In this embodiment, the floating member is a float ball 822, and the diameter of the float ball 822 is greater than the diameter of the air vent 832.

In a further solution of this embodiment, the float ball 822 is arranged inside the sewage temporary storage device 820, and the air vent 832 is arranged on the top wall of the sewage temporary storage device 820. Preferably, the isolation mechanism further includes a guiding part 823 extending from the bottom of the sewage temporary storage device 820 to the air vent 832, and the guiding part 823 has a hollow channel, and the float ball 822 is arranged in the hollow channel.

Figure 9:
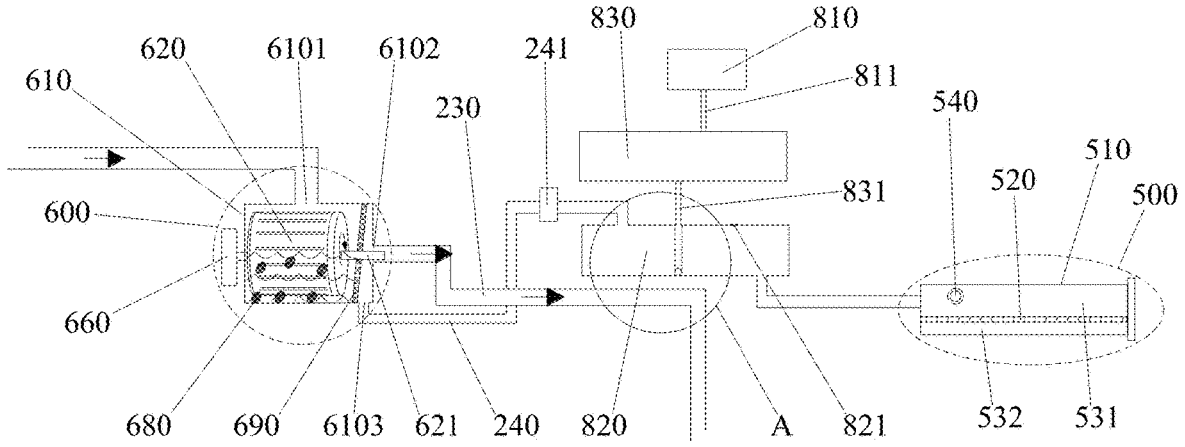
FIG. 9 is a schematic diagram of the communication structure between the filtering device and the recovery device in the Embodiment 6 of the present disclosure (there is no water in the sewage temporary storage device)
Figure 10:
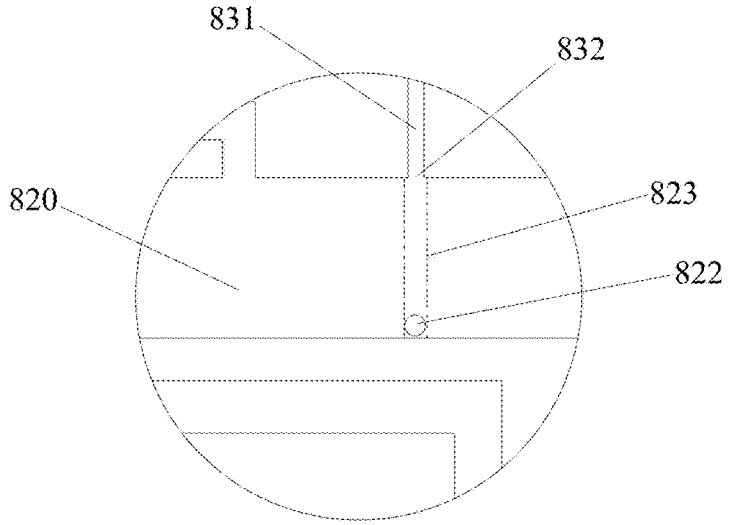
FIG. 10 is an enlarged schematic diagram of section A in FIG. 9 of the present disclosure.
Figure 11:
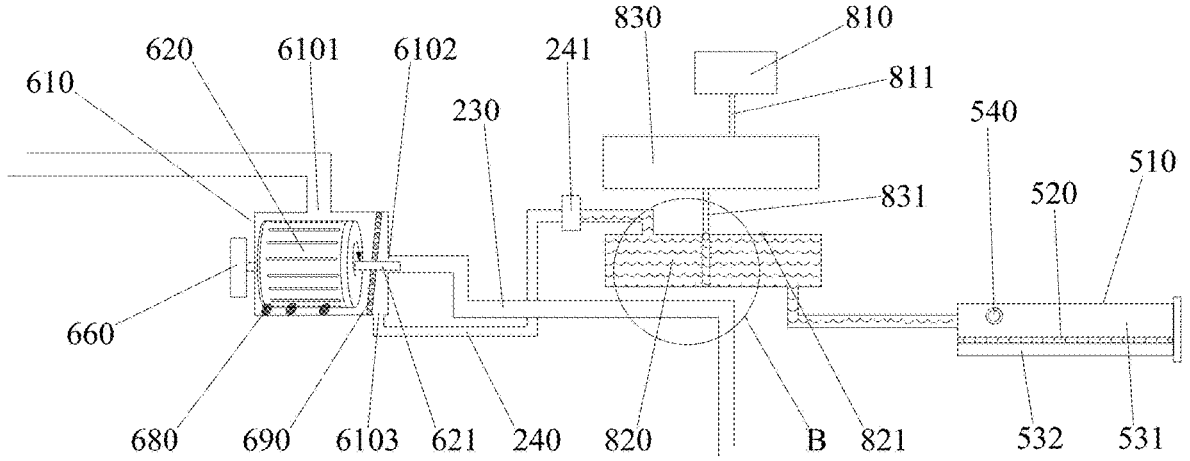
FIG. 11 is a schematic diagram of the connection structure between the filtering device and the recovery device in the Embodiment 6 of the present disclosure (the sewage temporary storage device is full of water)
Figure 12:
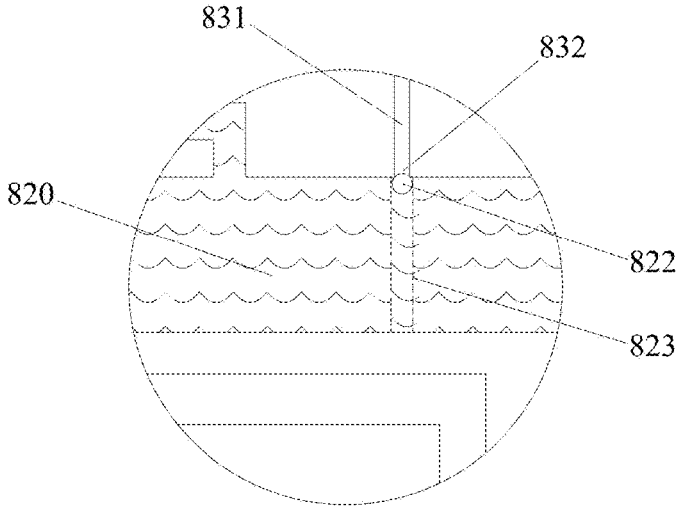
FIG. 12 is an enlarged schematic diagram of section B in FIG. 11 of the present disclosure.

As shown in FIGS. 9 and 10, in the initial state, there is no water in the temporary sewage storage device 820, and the float ball 822 is located at the bottom of the guiding part 823. In the process of sewage being discharged into the temporary sewage storage device 820, the water level in the temporary sewage storage device 820 gradually rises. A through hole for connecting the hollow channel with the external space of the guiding part 823 is provided on the side wall of the guiding part 823, and the water level inside the guiding part 823 rises synchronously, and the float ball 822 always floats at the height of the water level and gradually rises as the water level rises. As shown in FIGS. 11 and 12, when the temporary sewage storage device 820 is filled with water, the float ball 822 rises to the top of the temporary sewage storage device 820 with the water level, and blocks the air vent 832 from below, so that the sewage cannot further overflow upward through the air vent 832, thereby ensuring that the sewage will not overflow from the air vent 832 into the air pump 810.

In the above scheme, the air vent 832 is blocked by the float ball 822 disposed in the sewage temporary storage device 820. The air vent 832 can be blocked when the sewage temporary storage device 820 is full of water. Under the premise of ensuring that the sewage does not enter the air pump 810, the filtering device 600 can discharge a larger amount of sewage at one time, thereby improving the efficiency of sewage discharge. The guiding part 823 is provided to guide the movement of the float ball 822. The float ball 822 can only reciprocate inside the guiding part 823, thereby avoiding the situation where the movement trajectory of the float ball 822 is offset and the air vent 832 cannot be blocked.

In this embodiment, the guiding part 823 is a circular tubular structure, and the inner diameter of the guiding part 823 is larger than the outer diameter of the float ball 822. A clearance fit is formed between the float ball 822 and the guiding part 823, which reduces or even eliminates the friction resistance of the float ball 822 when it reciprocates inside the guiding part 823, thereby avoiding the situation where the float ball 822 is stuck inside the guiding part 823 and cannot rise with the water surface.

In the preferred solution of this embodiment, the guiding part 823 is vertically extended inside the sewage temporary storage device 820, which is more conducive to the float ball 822 rising unhindered as the water level rises to block the air vent 832.

In this embodiment, the lower end of the ventilation pipeline 831 is connected to the top wall of the sewage temporary storage device 820, and the connection between the ventilation pipeline 831 and the sewage temporary storage device 820 forms an air vent 832. The diameter of the float ball 822 is larger than the diameter of the ventilation pipeline 831. The float ball 822 blocks the air vent 832 as the water surface rises, that is, the float ball 822 moves to the lower end of the ventilation pipeline 831 to block the lower end opening of the ventilation pipeline 831.

In this embodiment, by setting a float ball 822 and a guiding part 823 in the sewage temporary storage device 820, when the sewage fills the sewage temporary storage device 820, the upper air vent 832 can be blocked by the float ball 822 to prevent the sewage from overflowing from the air vent 832. As a result, the sewage will not overflow into the air pump 810, thereby ensuring the working performance of the air pump 810.

Embodiment 7

The present embodiment differs embodiment 6 from that the isolation mechanism composed of the float ball and the guiding part is arranged inside the buffer portion.

Specifically, an air vent is arranged on the top wall of the buffer portion, and is connected to the air pump through a suction pipeline. A guiding part is arranged inside the buffer portion, extending vertically upward from the bottom to the air vent, a through hole is arranged on the side wall of the guiding part, and a float ball is arranged inside the guiding part.

In this embodiment, the volume of the sewage temporary storage device is set to be larger than the volume of the filtering device. When the washing machine is operating normally, the sewage generally does not completely fill the sewage temporary storage device. However, in some abnormal cases, a large amount of sewage may enter the sewage temporary storage device, causing overflow. At this time, the sewage flows upward along the ventilation pipeline into the buffer portion, gradually accumulates in the buffer cavity of the buffer portion, and will not be directly sucked into the air pump.

When sewage enters the buffer portion, the water level in the buffer portion gradually rises, and the float ball gradually rises in the guiding part as the water level rises, approaching the air vent at the top. When the buffer portion is also filled with sewage, the float ball rises to the top of the guiding part, which can block the air vent at the lower end of the suction pipeline, preventing sewage from overflowing from the buffer portion and being sucked into the air pump.

Embodiment 8

Figure 13:
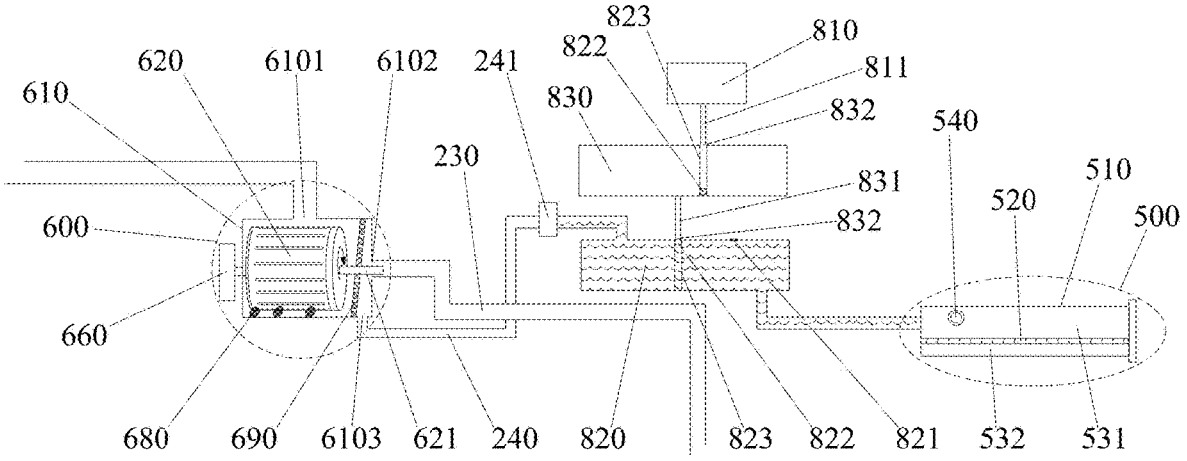
FIG. 13 is a schematic diagram of the communication structure between the filtering device and the recovery device in the Embodiment 8 of the present disclosure.

As shown in FIG. 13, the difference between this embodiment and embodiment 6 is that an isolation mechanism consisting of a float ball 822 and a guiding part 823 is provided in the sewage temporary storage device 820 and the buffer portion 830, and the air vent 832 that can be blocked by corresponding float ball 822 is respectively provided on the top wall of the sewage temporary storage device 820 and the top wall of the buffer portion 830.

Specifically, the lower end of the ventilation pipeline 831 is connected to the top wall of the sewage temporary storage device 820 to form a air vent 832. The lower end of the suction pipeline 811 is connected to the top wall of the buffer portion 830 to form another air vent 832.

Under normal circumstances, when the filtering device 600 discharges sewage, the float ball 822 in the sewage temporary storage device 820 rises with the water level until it moves to the top of the sewage temporary storage device 820 to block the air vent 832, preventing sewage from overflowing from the sewage temporary storage device 820. However, when the float ball 822 in the sewage temporary storage device 820 is accidentally stuck and cannot move, the ventilation pipeline 831 will always maintain a state of mutual communication with the sewage temporary storage device 820. When the filtering device 600 continues to discharge sewage, the sewage will go up along the ventilation pipeline 831 and enter the buffer portion 830.

The buffer portion 830 of this embodiment is also provided with a float ball 822. If sewage continues to enter the buffer portion 830, the float ball 822 in the buffer portion 830 gradually rises with the water surface. When the buffer portion 830 is also filled with sewage, the float ball 822 can block the air vent 832 on the top wall of the buffer portion 830, that is, the lower end of the suction pipeline 811 is blocked, so that the sewage cannot overflow from the buffer portion 830 into the air pump 810.

In this embodiment, the float ball 822 is provided in both the sewage temporary storage device 820 and the buffer portion 830, which plays a dual protection role. Even if the float ball 822 in the sewage temporary storage device 820 fails and causes sewage to overflow, the float ball 822 in the buffer portion 830 can still block the air vent 832 at the lower end of the suction pipe 811 when the sewage fills the buffer portion 830, thereby preventing the sewage from further overflowing the buffer portion 830 and entering the air pump 810, which is safer and more reliable.

Embodiment 9

The difference between this embodiment and the embodiment 6 is that the float ball is arranged between the sewage temporary storage device and the air pump. Specifically, the float ball is arranged in the ventilation pipeline connecting the sewage temporary storage device and the buffer portion.

In this embodiment, the ventilation pipeline has a diameter-reducing section extending from bottom to top, and the float ball is arranged inside the diameter-reducing section. The diameter of the top of the diameter-reducing section is smaller than the diameter of the float ball, and the float ball rises to the top of the diameter-reducing section with the water surface to achieve blocking.

To ensure that the float ball can freely reciprocate inside the reduced diameter section, the diameter of the bottom end of the reduced diameter section is larger than the diameter of the float ball. Further, a limit portion is provided below the reduced diameter section to prevent the float ball from falling into the sewage temporary storage device.

In a specific solution of this embodiment, the ventilation pipeline is in a tapered structure with a gradually decreasing cross-sectional diameter, and a plurality of small holes are arranged on the top wall of the sewage temporary storage device to communicate with the ventilation pipeline. The float is limited in the ventilation pipeline by the top wall of the sewage temporary storage device, and when sewage overflows from the sewage temporary storage device into the ventilation pipeline, the float ball rises with the water surface until it reaches a certain height of the ventilation pipeline, and the float ball is completely fitted with the inner wall of the ventilation pipeline along the circumferential direction to achieve blocking.

In another specific scheme of this embodiment, the diameter of the ventilation pipeline gradually increases from bottom to top, and then gradually decreases. The diameters of the top and bottom of the ventilation pipeline are both smaller than the diameter of the float, and the maximum diameter of the ventilation pipeline is larger than the diameter of the float ball. Since the diameter of the bottom of the ventilation pipeline is smaller than the diameter of the float ball, the float ball can be confined inside the ventilation pipeline. When sewage overflows from the sewage temporary storage device into the ventilation pipeline, the float ball rises with the water surface to a certain height of the ventilation pipeline, and the float ball is completely fitted with the inner wall of the ventilation pipeline along the circumferential direction to achieve blocking.

Embodiment 10

Figure 14:
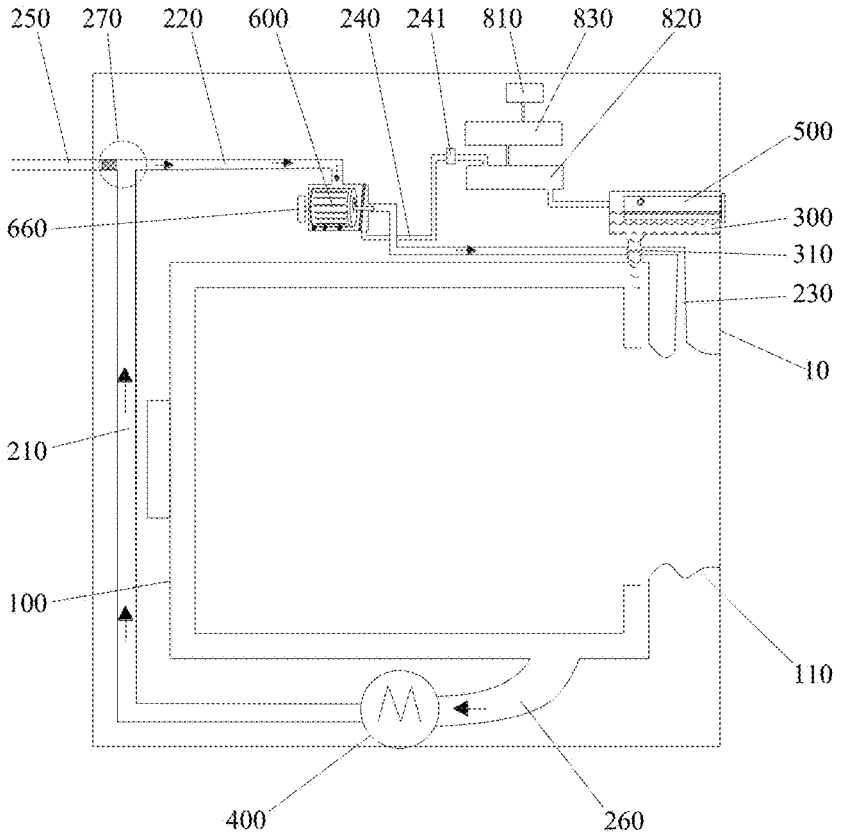
FIG. 14 is a schematic diagram of the internal structure of the washing machine in Embodiment 10 of the present disclosure.

As shown in FIG. 4 and FIG. 14, this embodiment is a further limitation of the above-mentioned embodiment 2. The recovery device 500 is directly or indirectly connected to the water container 100. After filtering the collected sewage, the filtered water is passed into the water container 100.

Specifically, the washing machine further comprises a detergent dispensing device connected to the water container 100 for delivering detergent into the water container 100. The recovery device 500 is connected to the detergent dispensing device, and the water filtered in the recovery device 500 is passed into the water container 100 through the detergent dispensing device.

Furthermore, the detergent dispensing device has a water inlet box 300 connected to the water container 100. A water outlet is provided on the housing 510 of the recovery device 500 for discharging filtered water, and the water outlet is connected to the water inlet box 300, so that the filtered clean water is passed into the water inlet box 300 and then enters the water container 100 through the water inlet box 300.

In detail, the water outlet is communicated with the second chamber 532 inside the recovery device 500, so that the clean water discharged from the water outlet is filtered by the filter component 520.

In the above scheme, since the water inlet box 300 itself is used to feed water into the water container 100, and the recovery device 500 returns water to the water container 100 through the water inlet box 300 of the detergent dispensing device, there is no need to add a structure connecting the recovery device 500 and the water container 100, which is conducive to simplifying the internal water path structure of the washing machine and avoiding too long water paths. After the recovery device 500 filters the collected sewage, the filtered clean water returns to the water container 100 through the water inlet box 300 for reuse, and can also flush the detergent that may exist in the water inlet box 300, thereby improving the utilization rate of the detergent.

In this embodiment, the water inlet box 300 can be connected to the water outlet of the second chamber 532 of the recovery device 500 through a pipeline. After the filtered clean water is discharged from the water outlet, it enters the water inlet box 300 through the pipeline, and then enters the water container 100 through the pipeline connecting the water inlet box 300 and the water container 100 to participate in the washing process.

In a preferred scheme of the present embodiment, the housing 510 of the recovery device 500 is arranged inside the water inlet box 300. After filtering the sewage discharged by the filtering device 600, the clean water flows out through the water outlet on the second chamber 532 and directly enters the water inlet box 300, and then enters the water container 100 along the pipe connecting the water inlet box 300 and the water container 100.

Through the above structure, the space inside the water inlet box 300 can be fully utilized, and there is no need to set up a separate pipeline to connect the recovery device 500 and the water inlet box 300, so that the internal structure of the washing machine is more compact, thereby saving the installation space inside the washing machine.

Since the water inlet box 300 has a certain space inside, the recovery device 500 is disposed inside the water inlet box 300 as a whole, and the filtered water flows out from the water outlet and enters the water inlet box 300, thereby achieving the purpose of passing the filtered water into the water inlet box 300. At the same time, the internal space of the water inlet box 300 can be fully utilized, so that the recovery device 500 does not occupy part of the space inside the washing machine alone, which is conducive to saving installation space.

On the other hand, the water outlet of the recovery device 500 is located inside the water inlet box 300, and there is no need to set up an additional pipeline to connect the water outlet and the water inlet box 300 to realize the transmission of the filtered water in the recovery device 500 to the water inlet box 300, thereby simplifying the pipeline structure inside the washing machine. The simplification of the pipeline structure makes the internal structure of the washing machine more compact, can reduce the space occupied by the peripheral structure of the water container 100, and contribute to the miniaturization design of the washing machine while ensuring the capacity of the washing machine.

In a further solution of this embodiment, the housing 510 is arranged inside the water inlet box 300 so as to be insertable/extractable. Specifically, the water inlet box 300 is arranged close to the inner wall of the box body 10 of the washing machine, and the user can insert the housing 510 into the box body 10 or extract it from the box body 10. The upper side of the housing 510 has an opening, and when the user extracts the housing 510, the filtered impurities attached to the upper surface of the filter component 520 can be cleaned through the opening on the upper side of the housing 510. The filter component 520 is preferably detachably connected to the housing 510, and the user can remove and take out the filter component 520 from the inside of the housing 510 for cleaning, which is more convenient to operate.

In a further solution of this embodiment, the water inlet box 300 is connected to the water inlet pipe 310, and the water inlet pipe 310 is connected to the water container 100. Preferably, the water outlet end of the water inlet pipe 310 is connected to the water container 100, and the water inlet pipe 310 includes a corrugated pipe with a certain length.

In the above scheme, the water inlet box 300 is directly connected to the water container 100 through the water inlet pipe 310, and the filtered water discharged from the recovery device 500 can be passed into the water container 100. Since the water container 100 vibrates to a certain extent during the operation of the washing machine, the water inlet pipe 310 includes at least one section of bellows, so that the displacement caused by the vibration of the water container 100 can be absorbed by the bellows, thereby avoiding the vibration of the water container 100 and the loosening of the connection structure between the water inlet pipe 310 and the water container 100, which causes water leakage.

Embodiment 11

Figure 15:
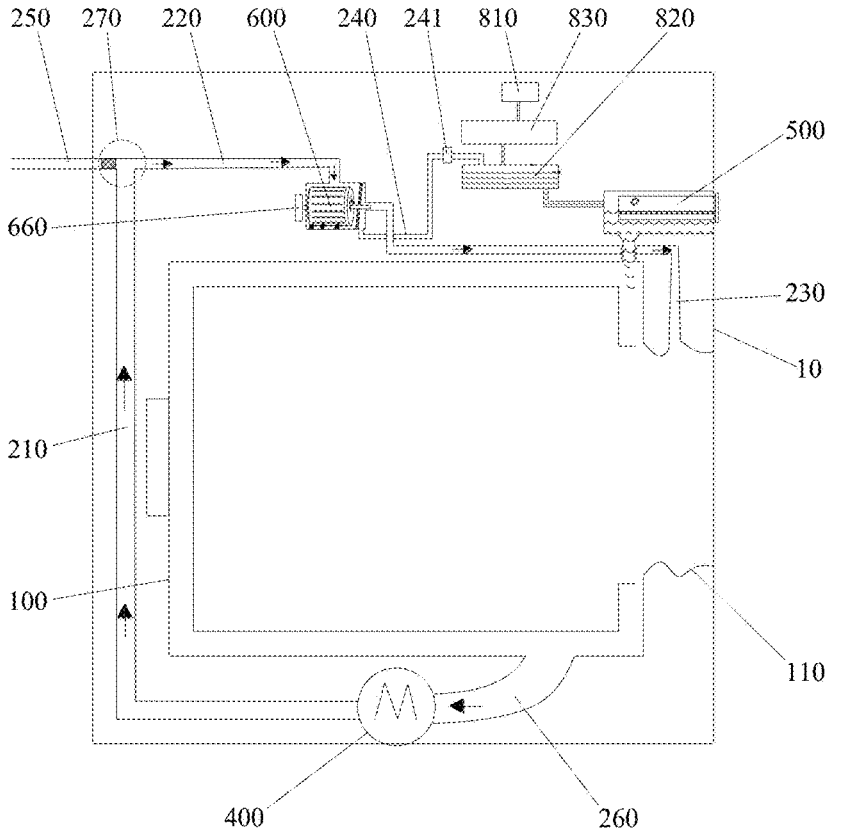
FIG. 15 is a schematic diagram of the internal structure of a washing machine in Embodiment 11 of the present disclosure.
Figure 16:
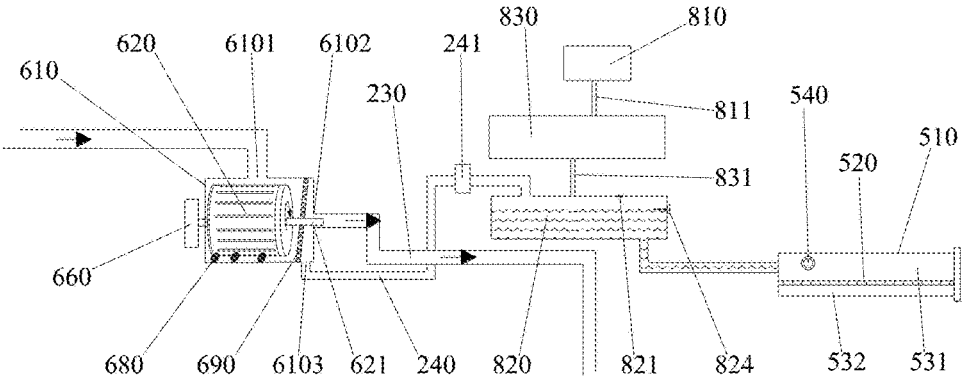
FIG. 16 is a schematic diagram of the communication structure between the filtering device and the recovery device in Embodiment 11 of the present disclosure.

As shown in FIG. 15 and FIG. 16, this embodiment is a further limitation of the above-mentioned embodiment 1. The suction device (i.e., the air pump 810) performs the suction action multiple times when the filtering device 600 needs to discharge sewage, thereby completing the discharge of sewage in the filtering device 600 in multiple times.

Specifically, the control method of the washing machine in this embodiment includes:

- S1', controlling the air pump 810 to perform a suction action to suck the air in the sewage temporary storage device 820, and the sewage in the filtering device 600 is discharged into the sewage temporary storage device 820 under the action of the pressure difference;
- S2', turning off the air pump 810 when a first set condition is reached, and the sewage in the sewage temporary storage device 820 enters the recovery device 500.

In the above manner, when the air pump 810 is turned on and reaches the first set condition, the washing machine can automatically control the air pump 810 to turn off, thereby stopping the suction of air in the sewage temporary storage device 820, and then the sewage in the filtering device 600 no longer enters the sewage temporary storage device 820. At the same time, since the suction effect of the air pump 810 disappears, the sewage stored in the sewage temporary storage device 820 can enter the recovery device 500 under the action of gravity, so that the sewage temporary storage device 820 is restored to a water-free state.

In the above scheme, it is only necessary to reasonably design the first set condition so that the amount of sewage discharged by the filtering device 600 to the sewage temporary storage device 820 at one time does not exceed the maximum capacity of the sewage temporary storage device 820 through program control, thereby preventing the sewage temporary storage device 820 from overflowing during the process of the filtering device 600 discharging sewage, avoiding sewage overflowing from the sewage temporary storage device 820 and entering the air pump 810, thereby protecting the air pump 810.

In this embodiment, since the drainage volume of the filtering device 600 when continuously discharging sewage is controllable, the volume of the sewage temporary storage device 820 can be set to be smaller than the volume of the filtering device 600, thereby reducing the overall volume of the sewage temporary storage device 820. By reducing the space occupied by the sewage temporary storage device 820 inside the washing machine box body 10, it is beneficial to improve the utilization rate of the internal space of the washing machine, thereby realizing the miniaturization design of the washing machine.

Furthermore, this embodiment controls the closing of the air pump 810 by detecting the water level in the sewage temporary storage device 820, so as to control the process of the filtering device 600 discharging sewage to the outside.

Specifically, in step S2' of the control method, the first set condition is that the water level in the sewage temporary storage device 820 rises to the first set water level. That is, during the period when the air pump 810 performs the suction action, when the washing machine detects that the water level in the sewage temporary storage device 820 rises to the first set water level, the air pump 810 is controlled to be turned off, and the sewage no longer enters the sewage temporary storage device 820, and the sewage already in the sewage temporary storage device 820 can be discharged into the recovery device 500, so that the water level in the sewage temporary storage device 820 drops.

In order to detect the water level in the sewage temporary storage device 820, a water level detection device 824 is provided on the sewage temporary storage device 820. When the water level in the sewage temporary storage device 820 reaches a first set water level, the water level detection device 824 sends out an early warning signal.

As shown in FIG. 16, the water level detection device 824 of this embodiment includes a first water level probe which is arranged in the internal cavity of the sewage temporary storage device 820 and is flush with the height of the first set water level. The first set water level is close to the full water level of the sewage temporary storage device 820, that is, the first water level probe is located at a height close to the top wall of the sewage temporary storage device 820, but has a certain interval with the top wall. When the first water level probe is submerged in sewage, the water level detection device sends out an early warning signal, and when the washing machine receives the early warning signal, it controls the air pump 810 to be turned off.

Since sewage may not stop entering the sewage temporary storage device 820 immediately when the air pump 810 is turned off, setting the first set water level close to but not reaching the full water level can ensure that the sewage temporary storage device 820 will not overflow.

In a further solution of this embodiment, the control method further includes step S3' after step S2': when the second set condition is reached, return to step S1'.

After the air pump 810 is turned off, the sewage stored in the sewage temporary storage device 820 is waited to be discharged into the recovery device 500, and then the air pump 810 can be controlled again to perform the suction action, so that the filtering device 600 continues to discharge the residual sewage inside. The above steps S1' to S3' are executed in sequence and cyclically until all the sewage in the filtering device 600 is discharged into the recovery device 500, that is, the process of the filtering device 600 discharging sewage is ended.

Similar to step S2', this embodiment also controls the air pump 810 to restart the suction action after being shut down by detecting the water level in the sewage temporary storage device 820. Specifically, in step S3', the second set condition is that the water level in the sewage temporary storage device 820 drops to the second set water level.

In this embodiment, the water level detection device 824 further includes a second water level probe that is flush with the height of the second set water level, and the second water level probe is close to or directly disposed on the bottom wall of the sewage temporary storage device 820. During the process of the sewage in the sewage temporary storage device 820 being discharged into the recovery device 500, the water level in the sewage temporary storage device 820 gradually decreases, and when the second water level probe leaks out of the water surface, the water level detection device 824 sends a release signal. After receiving the release signal, the washing machine controls the air pump 810 to perform the suction action again.

In another solution of this embodiment, the water level detection device 824 can also be composed of a float and a sensor. The float can float on the water surface and float up and down with the change of the water level in the sewage temporary storage device 820. The sensor is used to detect the height of the float and then determine the water level in the sewage temporary storage device 820.

Figure 17:
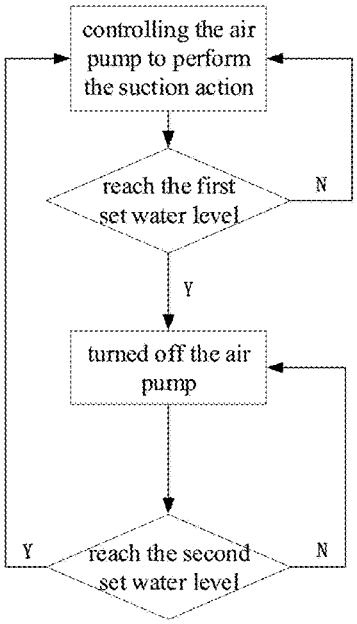
FIG. 17 is a flow chart of a control method for a washing machine in Embodiment 11 of the present disclosure.

As shown in FIG. 17, the control method of the washing machine in this embodiment specifically includes the following steps:

- S11', controlling the air pump to perform the suction action;
- S12', the water level in the sewage temporary storage device rises to the first set water level, and the air pump is turned off;
- S13', the water level in the sewage temporary storage device drops to the second set water level, and the process returns to step S11'.

Compared with the method in which the air pump 810 continuously works to suck until all the sewage in the filtering device 600 is discharged, the washing machine of this embodiment controls the air pump 810 to perform the suction action multiple times to complete the sewage discharge process of the filtering device 600. The amount of sewage discharged by the filtering device 600 is reduced in each suction action, which requires a lower power for the air pump 810. On the other hand, the duration of each suction action is shorter, which can avoid problems such as overheating caused by the long-term continuous operation of the air pump 810.

Embodiment 12

As shown in FIG. 4, the difference between this embodiment and the above-mentioned embodiment 11 is that: the washing machine controls the air pump 810 to shut down by the duration of the suction action performed by the air pump 810, so as to prevent the sewage temporary storage device 820 from overflowing. Accordingly, the sewage temporary storage device 820 of this embodiment may not be provided with a water level detection device.

Specifically, in the step S2' of this embodiment, the first set condition is that the duration of the suction action reaches the first preset duration $t_1$. That is, after the air pump 810 starts to perform the suction action, the washing machine starts timing, and when the first preset duration $t_1$ is reached. the air pump 810 is controlled to be turned off.

Further, in step S3', the second setting condition is that the air pump 810 is turned off for a second preset time $t_2$. That is, after the air pump 810 is turned off, the washing machine restarts the timing, and when the second preset time $t_2$ is reached, the air pump 810 is controlled to perform the suction action again.

In the above scheme, the specific values of the first preset time length $t_1$ and the second preset time length $t_2$ can be obtained in advance through a large number of experiments and directly written into the control program of the washing machine. Specifically, the value of the first preset time length $t_1$ is approximately the time required for the sewage temporary storage device 820 to rise from a waterless state to a nearly full water state when the air pump 810 is running at normal power. The value of the second preset time length $t_2$ is approximately the time required for the sewage temporary storage device 820 to drain water from a full water state to an empty state.

Figure 18:
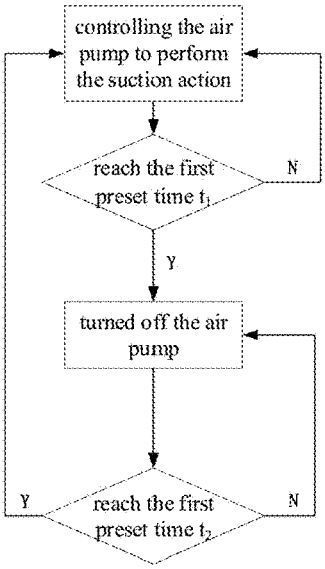
FIG. 18 is a flow chart of a control method for a washing machine in Embodiment 12 of the present disclosure.

In detail, as shown in FIG. 18, the control method of the washing machine in this embodiment specifically includes the following steps:

S21', controlling the air pump to perform the suction action;

S22', the duration of the suction action reaches the first preset time $t_1$, and the air pump is turned off;

S23', the air pump is turned off for a second preset time $t_2$, and the process returns to step S21'.

It should be noted that the solution of this embodiment can also be combined with the solution of the embodiment 11 and applied to a washing machine. For example, when the air pump 810 performs the suction action, the water level in the sewage temporary storage device 820 is detected, and the air pump 810 is controlled to be turned off after reaching the first set water level; then, the timing starts after the air pump 810 is turned off, and the air pump 810 is controlled to perform the suction action again after reaching the second preset time $t_2$; the above process is repeated until all the sewage in the filtering device 600 is discharged.

In this embodiment, the washing machine controls the duration of the suction action of the air pump 810 and the duration of the shutdown, so as to discharge the sewage in the filtering device 600 in multiple times. It also prevents the sewage temporary storage device 820 from overflowing and avoids water entering the air pump 810.

Embodiment 13

As shown in FIG. 15 and FIG. 16, this embodiment is a further limitation of the above-mentioned embodiment 11 or embodiment 12, and is used to control the end of the sewage discharge process of the filtering device 600.

In this embodiment, the control method of the washing machine includes the following steps:

S1', controlling the air pump 810 to perform a suction action to suck the air in the sewage temporary storage device 820, and the sewage in the filtering device 600 is discharged into the sewage temporary storage device 820 under the action of the pressure difference;

S2', turning off the air pump 810 when the first set condition is reached, and the sewage in the sewage temporary storage device 820 enters the recovery device 500;

S3', returning to step S1' when the second setting condition is reached.

In order to control the end of the sewage discharge process of the filtering device 600, this embodiment can be implemented through the following solutions.

Solution 1, step A is further included between step S2' and step S3': determining whether the number of executions of step S1' reaches a preset number N, if so, ending the sewage discharge process of the filtering device 600, if not, executing step S3'.

When the filtering device 600 discharges sewage, the amount of sewage discharged by the air pump 810 each time performing a suction action is substantially the same, and is close to the volume of the temporary sewage storage device 820. In the above scheme, the total number of suction actions required for the sewage in the filtering device 600 to be completely discharged during one sewage discharge process can be preset as the preset number N according to the volume ratio of the filtering device 600 and the temporary sewage storage device 820. When the filtering device 600 discharges sewage, the air pump 810 is controlled to perform a total of N suction actions, thereby completing the sewage discharge process of the filtering device 600.

Solution 2, step B is included between step S1' and step S2': within the third preset time $t_3$, if the water level in the sewage temporary storage device 820 does not reach the third set water level, the air pump 810 is turned off to end the sewage discharge process of the filtering device 600, otherwise step S2' is executed.

In the above scheme, the third preset time $t_3$ is not longer than the first preset time $t_1$, and the third set water level is not higher than the first set water level. The specific values of the third preset time $t_3$ and the third set water level are obtained in advance through testing, and meet the following conditions: when the air pump 810 works at normal power and there is undischarged sewage in the filtering device 600, the air pump 810 is continuously turned on for the third preset time $t_3$, and the water level in the sewage temporary storage device 820 should not be lower than the third set water level. If the water level in the sewage temporary storage device 820 fails to reach the third set water level, it means that the sewage in the filtering device 600 has been completely discharged, and the sewage discharge process can be ended.

Solution 3, the washing machine is provided with a detection device for detecting the discharge of sewage from the filtering device 600. When the detection device detects that the sewage in the filtering device 600 is completely discharged, the sewage discharge process of the filtering device 600 is controlled to end.

Specifically, the detection device may be a water level gauge disposed on the filtering device 600, and determines whether the sewage is completely discharged by detecting the water level in the filtering device 600.

Alternatively, the detection device is a flow meter disposed on the sewage pipeline 240. During the suction action of the air pump 810, if the flow meter detects that the water flow is continuously interrupted, it is determined that the sewage in the filtering device 600 has been completely discharged.

Alternatively, the detection device may collect images of the interior of the filtering device 600 and determine whether the sewage is completely discharged based on the collected images.

Through the above scheme provided in this embodiment, it can be ensured that after the sewage in the filtering device 600 is completely discharged, the washing machine can automatically control to end the sewage discharge process of the filtering device 600, and then continue to execute the subsequent required running programs, thereby ensuring the working efficiency of the washing machine.

Embodiment 14

Figure 19:
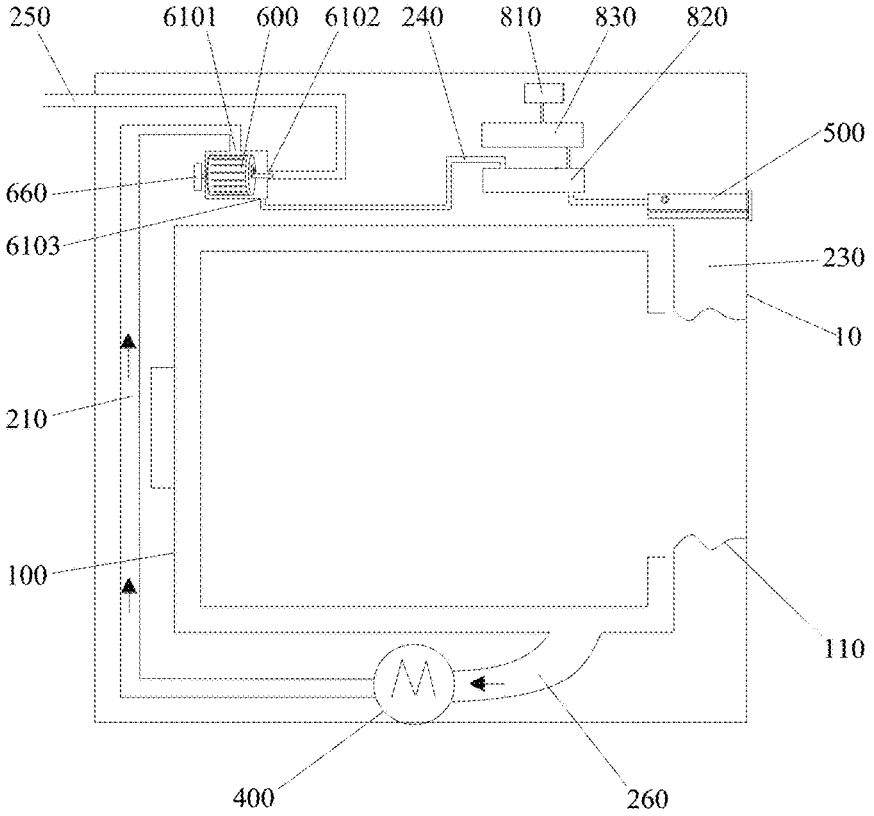
FIG. 19 is a schematic structural diagram of a washing machine in Embodiment 14 of the present disclosure.
Figure 20:
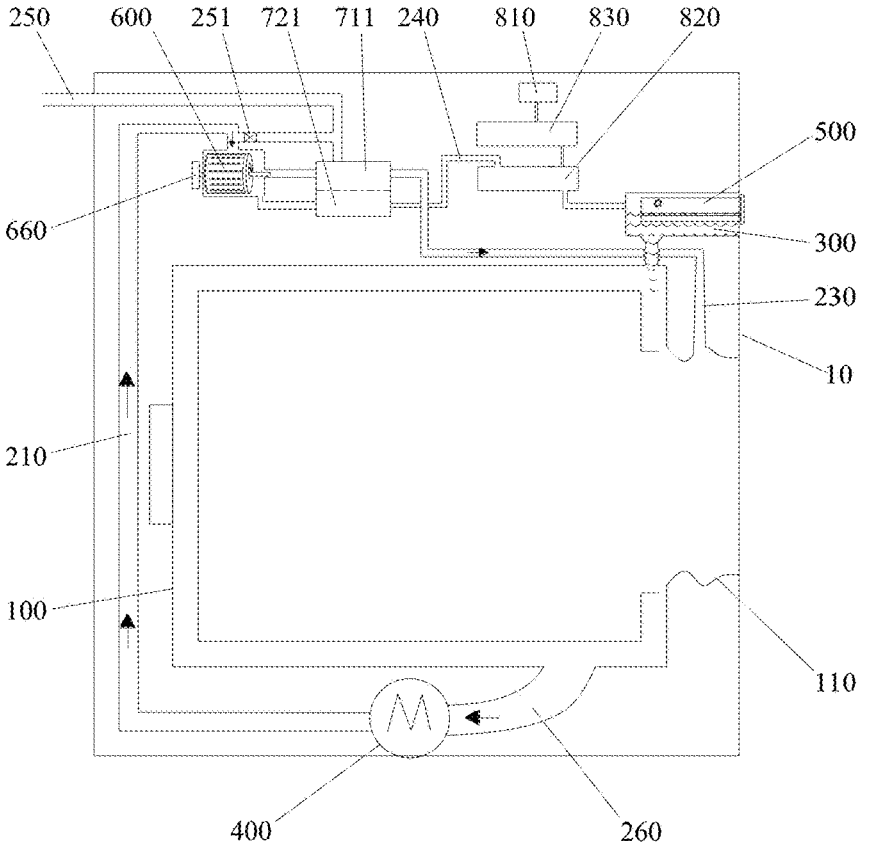
FIG. 20 is a schematic structural diagram of a washing machine in Embodiment 15 of the present disclosure.
Figure 21:
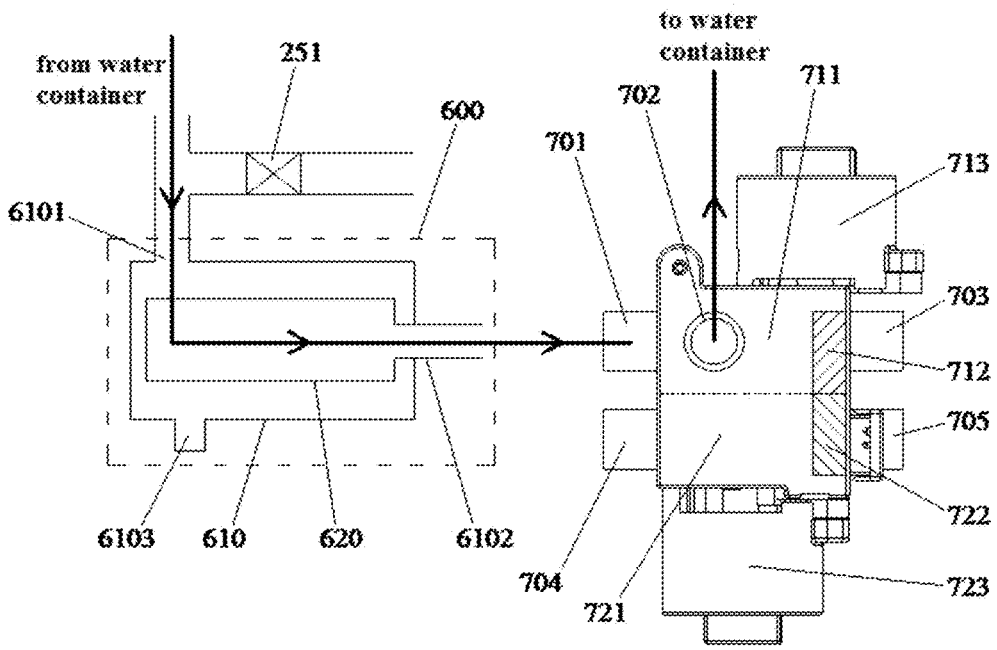
FIG. 21 is a schematic diagram of waterway connection during the washing/rinsing process in Embodiment 15 of the present disclosure.
Figure 22:
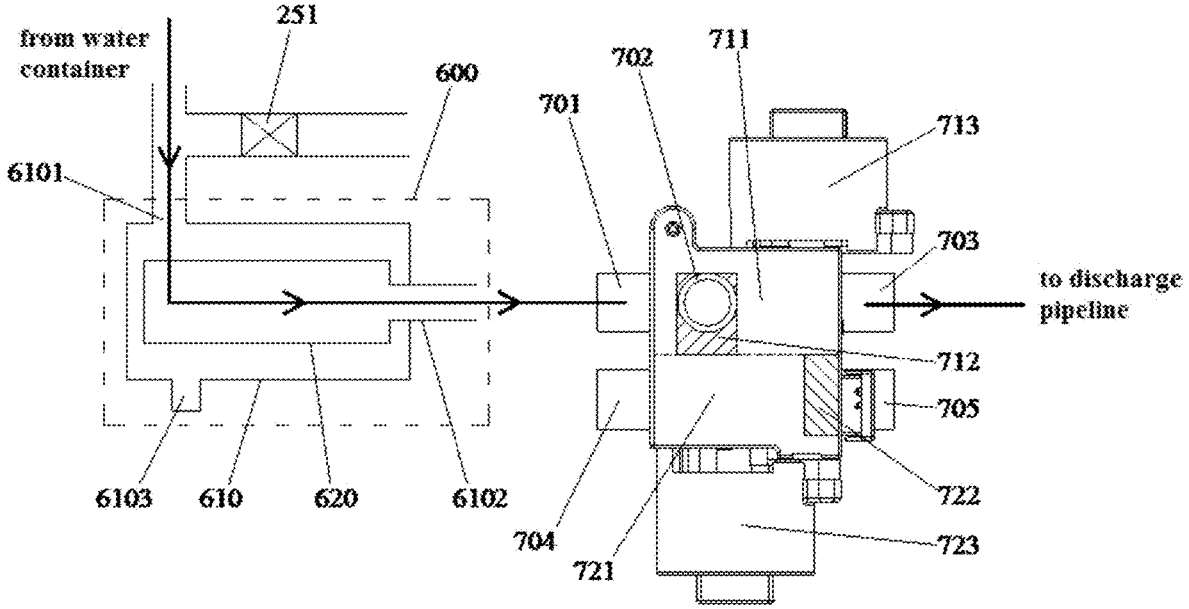
FIG. 22 is a schematic diagram of waterway connection in the drainage stage in Embodiment 15 of the present disclosure.
Figure 23:
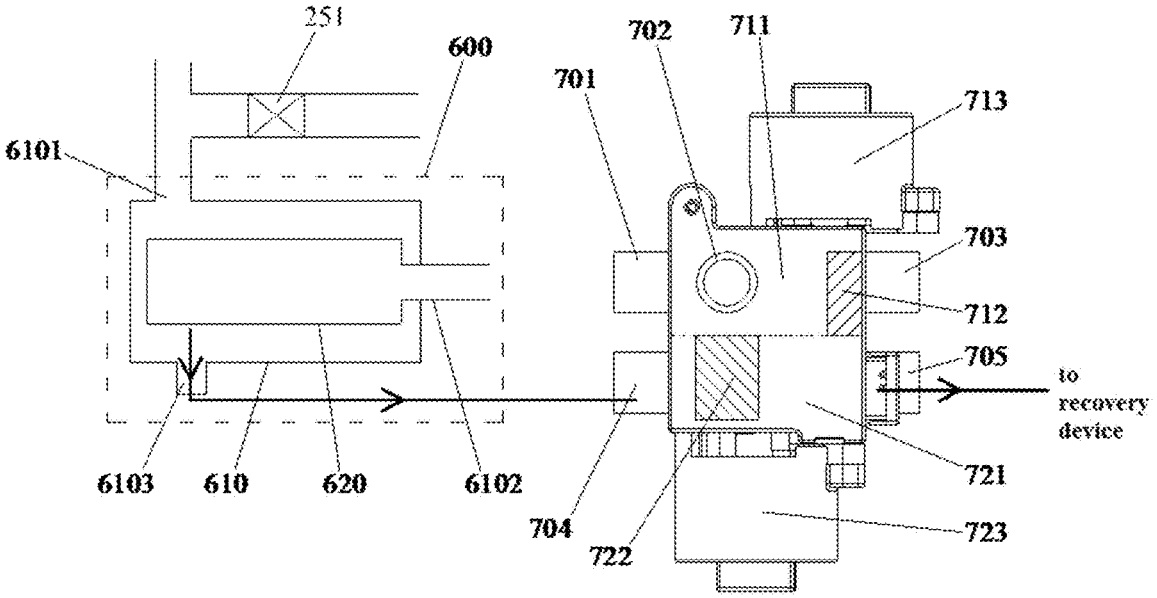
FIG. 23 is a schematic diagram of waterway connection during the sewage discharge process of the filtering device in Embodiment 15 of the present disclosure.
Figure 24:
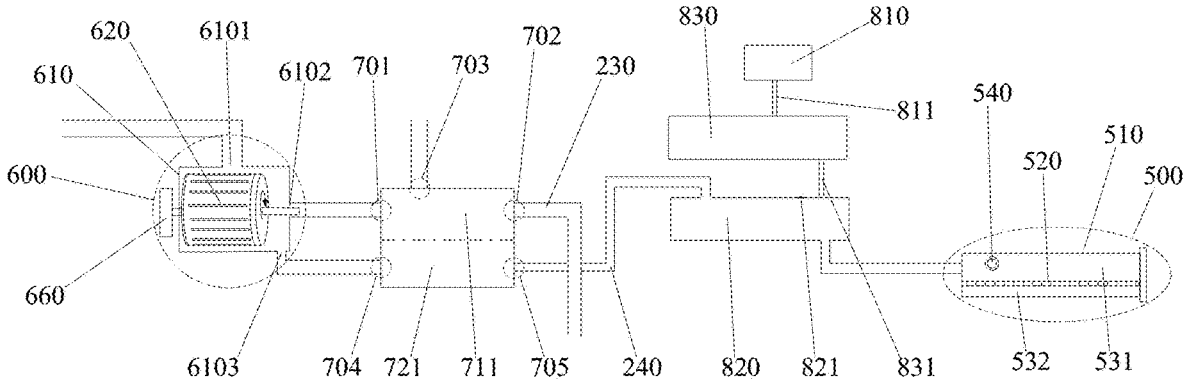
FIG. 24 is a schematic diagram of the connection structure between the filtering device and the recovery device in the Embodiment 15 of the present disclosure.

As shown in FIG. 19, the washing machine described in this embodiment includes:

a water container 100;

a discharge pipeline 250 is used to drain water to the outside of the washing machine;

a filtering device 600 receives water in the water container 100 for filtering, and has a water inlet 6101 and a filtered water outlet 6102.

The filtered water outlet 6102 of the filtering device 600 is connected to the discharge pipeline 250. When the washing machine is draining water, the water in the water container 100 is filtered by the filtering device 600 to remove impurities, and then discharged from the discharge pipeline 250.

Specifically, in this embodiment, the filtered water outlet 6102 of the filtering device 600 is directly connected to the discharge pipeline 250, that is, the water inlet end of the discharge pipeline 250 is connected to the filtered water outlet 6102.

In the above scheme, the drainage water of the washing machine is first filtered by the filtering device 600 and then discharged from the discharge pipeline 250, which can ensure that the drainage of the washing machine does not contain filtered impurities, thereby avoiding the problem that microplastics contained in the filtered impurities are discharged with the water flow and enter the ecological cycle, thereby causing harm to the ecological environment and human health.

Furthermore, a sewage outlet 6103 is provided on the filtering device 600 of this embodiment, and the filtered impurities remaining in the filtering device 600 during the filtering process can be discharged from the sewage outlet 6103 along with the water flow, without the need for the user to take out the filtering device 600 for manual cleaning, which is more convenient to use. A recovery device 500 is provided inside the washing machine, and the sewage discharged from the sewage outlet 6103 is finally passed into the recovery device 500 for collection, and the filtered impurities therein will not flow into the drainage water flow but be directly discharged from the washing machine. The recovery device 500 can process the received sewage, thereby collecting the filtered impurities in the sewage and preventing the filtered impurities from entering the natural water cycle.

Through the above method, it is ensured to the greatest extent that no filtered impurities are discharged with the drainage water flow of the washing machine, thereby avoiding the problem of microplastics contained in the filtered impurities entering the ecological cycle.

In this embodiment, a delivery pump 400 is provided between the water container 100 and the water inlet 6101 of the filtering device 600. Specifically, the water container 100 is connected to the water container drainage pipe 260, the water container drainage pipe 260 is connected to the water inlet end of the delivery pump 400, the water outlet end of the delivery pump 400 is connected to the drainage pipeline 210, and is connected to the water inlet 6101 of the filtering device 600 through the drainage pipeline 210. The sewage outlet 6103 of the filtering device 600 is connected to the sewage pipeline 240 for conveying the discharged sewage, and the sewage pipeline 240 is provided with a sewage valve 241, so that the sewage pipeline 240 can be controlled to be on and off.

During the drainage stage of the washing machine, the sewage valve 241 is closed, the delivery pump 400 is turned on, and the water in the water container 100 is passed into the filtering device 600 under the action of the delivery pump 400, and after the impurities are filtered out by the filtering device 600, the water is discharged from the washing machine through the discharge pipeline 250. After the drainage is completed, the sewage valve 241 is opened, the sewage pipeline 240 is connected, and the residual sewage in the filtering device 600 can be discharged from the sewage outlet 6103, and finally enters the recovery device 500 through the sewage pipeline 240.

The washing machine of this embodiment can filter the drainage water flow through the filtering device 600 to remove the filtered impurities in the drainage water flow, and prevent the filtered impurities containing microplastics from being directly discharged from the washing machine with the drainage water flow, thereby avoiding the problem of excessive microplastic content in the drainage of the washing machine and harming the ecological environment.

Embodiment 15

As shown in FIGS. 20 to 24, the present embodiment is different from the above-mentioned embodiment 1 in that the filtered water outlet 6102 of the filtering device 600 is indirectly connected to the discharge pipeline 250. For example, the filtered water outlet 6102 is connected to a transfer device, such as a water storage tank or a water valve, and the water inlet end of the discharge pipeline 250 is connected to the transfer device, thereby achieving indirect communication between the filtered water outlet 6102 and the discharge pipeline 250.

In this embodiment, a first switching device is provided between the filtered water outlet 6102 of the filtering device 600 and the discharge pipeline 250, and the first switching device is used to realize indirect communication between the filtered water outlet 6102 and the discharge pipeline 250. The first switching device is also connected to the water container 100, and can be used to control the water container 100 and the discharge pipeline 250 to select one of them to be connected to the filtered water outlet 6102 of the filtering device 600.

Specifically, the first switching device includes a first valve body 711 having a first valve chamber, and the first valve body 711 is provided with a water inlet 701 connected to the filtered water outlet 6102, a circulating water outlet 702 connected to the water container 100 through the return water pipeline 230, and a drainage outlet 703 connected to the discharge pipeline 250. A switching mechanism 712 is provided in the first valve chamber, and the switching mechanism 712 is movably installed in the first valve chamber, and can selectively open the circulating water outlet 702 and the drainage outlet 703.

During the washing/rinsing process of the washing machine, the first switching device is controlled to connect the water container 100 and the filtered water outlet 6102 of the filtering device 600, that is, the switching mechanism 712 is controlled to open the circulating water outlet 702. After the delivery pump 400 is turned on, the water in the water container 100 is pumped into the filtering device 600, enters the first valve chamber after filtration, and then flows out from the circulating water outlet 702 and enters the return water pipeline 230. The return water pipeline 230 is specifically connected to the window pad 110 at the opening of the water container 100, and the water filtered by the filtering device 600 to remove the filtered impurities returns to the water container 100 from the window pad 110. The water in the water container 100 can be continuously circulated through the filtering device 600 under the action of the delivery pump 400, thereby filtering out the filtered impurities in the water. The content of filtered impurities in the washing/rinsing water is reduced, which can improve the washing effect of the washing machine.

During the drainage stage of the washing machine, the first switching device is controlled to connect the discharge pipeline 250 and the filtered water outlet 6102 of the filtering device 600, that is, the switching mechanism 712 is controlled to open the drainage outlet 703. After the delivery pump 400 is turned on, the water in the water container 100 is pumped to the filtering device 600, enters the first valve chamber after filtering, and flows out from the drainage outlet 703 into the discharge pipeline 250. The water in the water container 100 can filter impurities through the filtering device 600 and then be discharged through the discharge pipeline 250, so that the content of filtered impurities in the drainage of the washing machine is significantly reduced.

In the above solution, the washing machine is provided with a first switching device downstream of the filtered water outlet 6102 of the filtering device 600, which can control the flow direction of the filtered water discharged from the filtering device 600, so that the washing machine can use the same filtering device 600 to perform washing/rinsing during the washing/rinsing stage. The rinse water is circulated and filtered, and the drainage water flow is filtered during the drainage stage. The washing machine does not need to install filter structures at different positions of the waterway structure, thus simplifying the internal structure of the washing machine.

In this embodiment, the switching mechanism 712 in the first valve chamber specifically includes:

- a flap, being rotatably mounted in the first valve chamber and has a first surface and a second surface opposite to each other;
- a drainage seal, disposed on the first surface of the flap, for sealing the drainage outlet 703;
- a circulation seal is arranged on the second surface of the flap, for sealing the circulation water outlet 702.

In detail, the water inlet 701 of the first valve body 711 is arranged on the left chamber wall, the circulating water outlet 702 is arranged on the front chamber wall, and the drainage outlet 703 is arranged on the right chamber wall. The flap of the switching mechanism 712 rotates 90 degrees around its rotation axis, and the state in which the drain seal blocks the drainage outlet 703 is switched to the state in which the circulating seal blocks the circulating water outlet 702.

Furthermore, the first switching device further includes a first driving element for driving the flap to rotate in the first valve chamber. The first driving element of this embodiment is a first motor 713 disposed outside the first valve body 711, and the driving end of the first motor 713 is connected to the flap, which drives the flap to rotate to a position where the drainage seal blocks the drainage outlet 703 during the washing/rinsing process of the washing machine, and drives the flap to rotate to a position where the circulation seal blocks the circulating water outlet 702 during the drainage stage of the washing machine.

In a specific solution of this embodiment, the filtering device 600 includes:

- a filtering cavity 610 has a water inlet 6101, a filtered water outlet 6102 and a sewage outlet 6103;
- The filtering mechanism 620 is rotatably disposed inside the filtering cavity 610;
- a driving mechanism 660 is connected to the filtering mechanism 620 and is used to drive the filtering mechanism 620 to rotate in the filtering cavity 610.

The filtering mechanism 620 includes a filter holder and a filter screen covering the surface of the filter holder, which divides the interior of the filtering cavity 610 into an outer chamber and an inner chamber. The water in the water container 100 enters the outer cavity of the filtering cavity 610 through the water inlet 6101. The filtered impurities in the water are blocked by the filter screen and adhere to the outer surface of the filtering mechanism 620. The clean water without filtered impurities enters the inner cavity and is finally discharged from the filtering cavity. The filtered water outlet 6102 flows out of the filtering cavity 610. By designing the pore size of the filter, the filtering mechanism 620 can not only filter large-sized lint in the water, but also filter microplastics in the water, thereby significantly reducing the content of microplastics in the drainage of the washing machine.

When the filtering device 600 needs to be cleaned, the filtering mechanism 620 is driven to rotate in the filtering cavity 610 through a driving mechanism 660, such as a motor, to stir the residual water in the filtering cavity 610, so that the filtered impurities attached to the surface of the filtering mechanism 620 are peeled off from the filtering mechanism 620 under the action of centrifugal force and agitated water flow, and merged into the water in the filtering cavity 610, and then discharged from the sewage outlet 6103 with the water flow, and finally can enter the recovery device 500 to be collected.

The washing machine described in this embodiment further includes a sewage discharge control device, which is arranged between the sewage outlet 6103 of the filtering device 600 and the recovery device 500, and is used to control the connection/disconnection between the sewage outlet 6103 and the recovery device 500. When the filtering device 600 filters the water introduced, the sewage discharge control device disconnects the connection between the sewage outlet 6103 and the recovery device 500, so that the water entering the filtering device 600 will not flow out from the sewage outlet 6103, ensuring that the water received by the filtering device 600 can be discharged from the filtered water outlet 6102 after being filtered.

During the sewage discharge process of the filtering device 600, the sewage discharge control device connects the recovery device 500 with the sewage outlet 6103 of the filtering device 600, and the sewage carrying the filtered impurities is discharged through the sewage outlet 6103 and enters the recovery device 500 to be collected.

In this embodiment, the sewage control device includes a second valve body 721 having a second valve chamber, and a sewage inlet 704 and a sewage outlet 705 are arranged on the second valve body 721, and the sewage inlet 704 is connected to the sewage outlet 6103. A blocking mechanism 722 is arranged in the second valve chamber to block the sewage outlet 705. The sewage outlet 705 is connected to the sewage pipeline 240, and the sewage carrying the filtered impurities flows out from the sewage outlet 705 and finally enters the recovery device 500 along the sewage pipeline 240.

The sewage discharge control device further includes a second driving element for driving the blocking mechanism 722 to move in the second valve chamber to open/block the sewage outlet 705.

The specific structure of the blocking mechanism 722 is similar to the switching mechanism 712 in the first valve chamber, and is also composed of a rotatable flap and a seal installed on the flap. The sewage outlet 705 is arranged on the right chamber wall of the second valve body 721, and the flap can be controlled to rotate so that the seal blocks the sewage outlet 705, or the flap can be controlled to rotate in the opposite direction so that the seal is separated from the sewage outlet 705, thereby realizing the opening of the sewage outlet 705.

The second driving element is a second motor 723 disposed outside the second valve body 721. The driving end of the second motor 723 is connected to the flap in the second valve chamber, and can drive the flap to rotate in the second valve chamber to open or block the sewage outlet 705.

It is understandable that the positions of the sewage inlet and the sewage outlet on the second valve chamber can be swapped, so that the blocking mechanism moves in the second valve chamber to open/block the sewage inlet, and can also control the discharge of sewage in the filtering device.

In the preferred solution of this embodiment, the first valve body 711 and the second valve body 721 are connected as a whole, but the first valve chamber and the second valve chamber remain independent of each other, and the first motor 713 and the second motor 723 independently control the actions of the switching mechanism 712 and the blocking mechanism 722 respectively.

In the above solution, the first valve body 711 of the first switching device is connected to the second valve body 721 of the sewage control device as a whole, so that the two are integrated in the same space in the washing machine, the structure is more compact, and it is conducive to saving installation space.

In this embodiment, since the drainage of the washing machine passes through the filtering device 600 and the first valve body 711 in sequence and then enters the discharge pipeline 250 for drainage, during the drainage stage of the washing machine, once the drainage filter line (from the water inlet 6101 of the filtering device 600 to the drainage outlet 703 of the first valve body 711) is blocked, the washing machine will not be able to complete the drainage, and the washing program will be interrupted due to the drainage failure.

To solve this problem, in this embodiment, a three-way structure is provided between the water container 100 and the water inlet 6101 of the filtering device 600, the three-way structure is connected to the discharge pipeline 250, and an openable/closable control valve 251 is provided between the three-way structure and the discharge pipeline 250.

In the drainage stage of the washing machine, under normal circumstances, the control valve 251 is closed, the three-way structure and the discharge pipeline 250 are not connected, the water in the water container 100 is passed into the filtering device 600 for filtration, and then enters the discharge pipeline 250 through the drainage outlet 703 of the first valve body 711 and is discharged from the washing machine. When the drainage filter line is blocked, the control valve 251 is opened to connect the three-way structure with the discharge pipeline 250, and then the water in the water container 100 can be directly passed into the discharge pipeline 250 and discharged from the washing machine. At this time, the drainage of the washing machine is no longer filtered, but the normal operation of the washing program is prioritized.

In this embodiment, when the washing machine drains water, the water in the water container 100 is filtered by the filtering device 600 to remove the filtered impurities before being discharged from the washing machine, thereby preventing the microplastics that may exist in the washing machine drainage from being directly discharged with the drainage water flow and entering the ecological cycle. At the same time, a recovery device 500 is also provided in the washing machine to collect the sewage carrying the filtered impurities discharged by the filtering device 600, thereby preventing the filtered impurities cleaned from the filtering device 600 from being directly discharged from the washing machine, thereby causing excessive microplastic content in the washing machine drainage.

The first switching device is connected to the filtered water outlet 6102 of the filtering device 600, and is used to control the filtered water discharged from the filtering device 600 to be re-introduced into the water container 100, or into the discharge pipeline 250, so that the filtering device 600 can be used for the washing/rinsing water circulation filtration in the washing/rinsing stage, and can also be used for the drainage water flow filtration in the drainage stage, thereby simplifying the internal structure of the washing machine.

In this embodiment, the specific structure of the recovery device 500 is the same as that in the above-mentioned embodiment 10, and it can use the filter component 520 to filter the received sewage, and discharge the filtered water from the outlet on the second chamber 532, and re-introduce it into the water container 100 through the water inlet box 300 of the detergent dispensing device.

Furthermore, similar to the above-mentioned embodiment 2, the washing machine of this embodiment also includes a suction device, which can perform a suction action through the suction device to generate a negative pressure environment outside the sewage outlet 705 of the second valve body 721, thereby driving the sewage in the filtering device 600 to flow out through the sewage outlet 705 of the second valve body 721 under the action of the pressure difference and finally discharged into the recovery device 500.

Specifically, in this embodiment, the suction device is an air pump 810, and a sewage temporary storage device 820 having an internal chamber is provided between the sewage outlet 705 and the recovery device 500. The air pump 810 is connected to the internal chamber of the sewage temporary storage device 820 through a suction pipeline 811 to suck the air therein. The water outlet of the sewage temporary storage device 820 is higher than the sewage inlet of the recovery device 500, and a blocking member 540 that conducts one-way from outside to inside is provided at the sewage inlet 550 of the recovery device 500.

In this embodiment, the specific structure of the blocking member 540 is the same as that in the above-mentioned embodiment 3, and will not be described again.

When the filtering device 600 needs to discharge sewage, the air pump 810 is controlled to perform a suction action, and the sealing member 540 blocks the sewage inlet 550, so that the air between the sewage outlet 705 and the recovery device 500 is sucked out by the air pump 810, and a negative pressure environment is formed in the pipeline outside the sewage outlet 705. The sewage in the filtering device 600 can enter the second valve chamber under the action of the pressure difference and be discharged from the sewage outlet 705.

During the period when the air pump 810 is turned on, since the sewage inlet 550 of the recovery device 500 is blocked, air will not enter between the sewage outlet 705 and the recovery device 500 from the sewage inlet 550, and a strong pressure difference can be quickly formed inside and outside the sewage outlet 705 of the second valve body 721, thereby enabling the sewage in the filtering device 600 to be efficiently and quickly discharged into the recovery device 500 for collection. At the same time, the air pump 810 is only used to suck air to form a negative pressure environment, and the discharged sewage does not pass through the air pump 810, avoiding the problem of pump body blockage caused by water pump transportation.

When it is necessary to discharge the sewage in the filtering device 600, the washing machine performs the following steps in sequence:

S1", controlling the air pump 810 to perform a suction action, the sewage inlet 550 of the recovery device 500 is blocked by the blocking member 540, and the air in the sewage temporary storage device 820 is sucked out;

S2", the blocking mechanism 722 opens the sewage outlet 705, and the sewage in the filtering device 600 is discharged into the sewage temporary storage device 820 through the second valve body 721 under the action of the pressure difference;

S3", turning off the air pump 810, the blocking member 540 opens the sewage inlet 550, and the sewage in the sewage temporary storage device 820 is discharged into the recovery device 500 under the action of gravity.

In the above solution, by providing the sewage temporary storage device 820, after the sewage is pumped out from the filtering device 600 under the action of the pressure difference, it can be temporarily stored in the internal volume of the sewage temporary storage device 820. This avoids the situation where the sewage is sucked into the air pump 810 by the large suction force of the air pump 810 when it flows out of the filtering device 600 quickly, and plays a protective role on the air pump 810, preventing the working performance of the air pump 810 from being affected.

The blocking mechanism 722 blocks the sewage outlet 705 at the beginning of the suction operation of the air pump 810, and the filtering device 600 is not connected to the sewage temporary storage device 820. At the same time, the sewage temporary storage device 820 is not connected to the recovery device 500 due to the presence of the blocking member 540, so that a more obvious negative pressure environment can be formed more quickly in the sewage temporary storage device 820. Then, the blocking mechanism 722 is controlled to operate to open the sewage outlet 705, and the sewage in the filtering device 600 can be subjected to a greater driving force, so that it can be efficiently and fully discharged into the sewage temporary storage device 820.

Furthermore, a buffer portion 830 is provided between the air pump 810 and the sewage temporary storage device 820, and a buffer chamber is provided inside the buffer portion 830. The buffer chamber is communicated with the internal volume of the sewage temporary storage device 820, and the suction pipeline 811 is connected to the buffer portion 830, communicating the air pump 810 with the buffer chamber.

In the above scheme, after the air pump 810 is turned on, it can suck the inside of the buffer portion 830 and the sewage temporary storage device 820 to form a negative pressure state, and then after the blocking mechanism 722 opens the sewage outlet 705, the sewage in the filtering device 600 can be quickly discharged under the pressure difference. By placing the buffer portion 830 between the air pump 810 and the sewage temporary storage device 820, even if the amount of discharged sewage is large and overflows from the sewage temporary storage device 820, part of the overflowed sewage can be stored in the buffer chamber of the buffer portion 830, and will not directly enter the air pump 810.

In the preferred solution of this embodiment, the buffer portion 830 is arranged above the sewage temporary storage device 820, and is connected through a vertically extending ventilation pipeline 831, and the ventilation pipeline 831 is connected to the top of the sewage temporary storage device 820. On the one hand, the above structure can make full use of the internal volume of the sewage temporary storage device 820. When the internal volume is filled with sewage, the sewage can enter the ventilation pipeline 831, thereby increasing the amount of sewage that can be accommodated by the sewage temporary storage device 820. On the other hand, the height required for the sewage to enter the buffer portion 830 is increased, and the corresponding suction force required by the air pump 810 is greater, which can further prevent the sewage temporary storage device 820 from overflowing.

Similarly, the air pump 810 is arranged above the buffer portion 830, and the suction pipeline 811 vertically extends to connect the air pump 810 with the buffer chamber of the buffer portion 830. In this way, the suction force required for sewage to enter the air pump 810 is further increased, further preventing the air pump 810 from entering water.

In this embodiment, an air hole 821 is provided on the top of the sewage temporary storage device 820 to connect the internal volume of the sewage temporary storage device 820 with the external space. In particular, for the solution in which the sewage is discharged into the recovery device 500 by gravity, after the air pump 810 is turned off, the external air can enter the internal volume of the sewage temporary storage device 820 through the air hole 821, driving the sewage therein to flow toward the recovery device 500, thereby causing the blocking member 540 to open the sewage inlet 550, so that the sewage is discharged into the recovery device 500.

In the above scheme, the opening area of the air hole 821 is relatively small. When the air pump 810 is turned on to perform the suction action, the air entering the sewage temporary storage device 820 through the air hole 821 will not have a significant impact on the formation of the negative pressure environment. After the air pump 810 is turned off, the air in the sewage temporary storage device 820 is no longer extracted. Due to the setting of the air hole 821, the interior of the sewage temporary storage device 820 can quickly return to a pressure close to atmospheric pressure, and the entry of air pushes the sewage to be discharged into the recovery device 500. By providing the air hole 821 on the sewage temporary storage device 820, it is avoided that the air pressure in the recovery device 500 is too high, and the sewage cannot flow into the recovery device 500 after the air pump 810 stops working.

By setting an air pump 810 to suck air between the sewage outlet 705 of the second valve body 721 and the recovery device 500, and setting a one-way blocking member 540 at the sewage inlet 550 of the recovery device 500, a negative pressure environment can be quickly formed outside the sewage outlet 705, and the sewage in the filtering device 600 is driven to be discharged through the second valve body 721 by the pressure difference, and then the sewage impacts the blocking member 540 to open the sewage inlet 550, and the sewage is collected in the recovery device 500. Even if the distance between the filtering device 600 and the recovery device 500 is far or there is a height difference, the sewage in the filtering device 600 can be fully discharged. The sewage temporary storage device 820 is set between the filtering device 600 and the recovery device 500, and the sewage temporary storage device 820 is connected to the air pump 810 through the buffer portion 830, which effectively prevents the air pump 810 from sucking sewage when sucking air.

Embodiment 16

The difference between this embodiment and the above-mentioned embodiment 15 is that the water outlet on the recovery device is connected to the discharge pipeline, and the water filtered by the filter component is discharged from the washing machine through the discharge pipeline.

Since the recovery device is equipped with a filter component to filter the collected sewage, the filtered water no longer carries filtered impurities and can be directly passed into the discharge pipeline to be discharged from the washing machine, which will not cause the problem of microplastics entering the ecological cycle with the washing machine drainage.

Compared with the above-mentioned embodiment 15, this embodiment only changes the destination of the filtered water in the recovery device after discharge, which can also prevent the recovery device from overflowing and avoid the filtered impurities containing microplastics from being directly discharged from the washing machine.

Embodiment 17

The difference between this embodiment and the embodiment 15 is that the water outlet on the recovery device is connected to a second switching device, and the second switching device controls the water container and the discharge pipeline to selectively connect to the water outlet.

In the above scheme, the second switching device can be used to control the direction of the water flow discharged from the water outlet of the recovery device, so that the filtered water in the recovery device can be selectively returned to the water container, or passed into the discharge pipeline for direct discharge.

Specifically, after drainage of the washing is completed, the second switching device controls the discharge pipeline to be connected with the water outlet of the recovery device. After the sewage control device connects the sewage outlet with the recovery device, the sewage carrying the filtered impurities in the filtering device is discharged into the recovery device, and after being filtered by the filter component, it is discharged from the water outlet into the discharge pipeline and directly discharged from the washing machine. Since the washing and draining water contains high concentrations of detergent in addition to the filtered impurities, the detergent in the water cannot be filtered out by the filter component, resulting in the water discharged from the recovery device being unsuitable for the subsequent rinsing process. At this time, the water discharged from the recovery device is directly discharged from the washing machine through the second switching device.

After the intermediate drainage of the rinsing is completed, the second switching device controls the water container to be connected with the water outlet of the recovery device. After the sewage control device connects the sewage outlet with the recovery device, the sewage carrying the filtered impurities in the filtering device is discharged into the recovery device, and after being filtered by the filter component, it is discharged from the water outlet and returned to the water container. The cleanliness of the intermediate drainage of the rinsing is relatively high. After the filtered impurities are filtered out in the recovery device, it can be re-introduced into the water container for the subsequent rinsing process, thereby saving the amount of rinse water used in the washing machine.

After the final rinse and drainage, the second switching device controls the discharge pipeline to be connected to the water outlet of the recovery device. After the sewage control device connects the sewage outlet to the recovery device, the sewage carrying filtered impurities in the filtering device is discharged into the recovery device, and after being filtered by the filter component, it is discharged from the water outlet into the discharge pipeline and directly discharged from the washing machine. Since the washing machine no longer needs to take a large amount of water into the water container during subsequent operation, the water discharged from the recovery device can be directly discharged from the washing machine through the control of the second switching device.

In this embodiment, the washing machine can automatically control the water discharged by the recovery device to return it to the water container or directly discharge it from the washing machine according to different operation stages, which is more intelligent.

Embodiment 18

This embodiment provides a control method for the washing machine in the embodiment 15 described above.

As shown in FIG. 20 to FIG. 23, specifically, in the drainage stage, the switching mechanism 712 keeps blocking the circulating water outlet 702 and opening the drainage outlet 703, and the washing machine alternately performs drainage and filtering operations and sewage discharge operations.

The drainage and filtering operation includes: the delivery pump 400 is in an open state, the blocking mechanism 722 blocks the sewage outlet 705, and the water in the water container 100 is filtered by the filtering device 600 and then discharged from the discharge pipeline 250.

The sewage discharge operation includes: the delivery pump 400 is in a closed state, the blocking mechanism 722 opens the sewage outlet 705, and the sewage in the filtering device 600 is discharged into the sewage discharge pipeline 240.

In the above scheme, by alternately performing the drainage filtering operation and the sewage discharge operation during the drainage process of the washing machine, the filtered impurities remaining in the filtering device 600 during the drainage filtering process can be discharged in time, thereby preventing the filtered impurities from accumulating inside the filtering device 600 and affecting the filtering efficiency. In particular, when the content of filtered impurities in the water is high, the scheme of this embodiment effectively prevents excessive accumulation of filtered impurities and blockage of the filtering device 600, compared with the method of continuously performing the filtering operation until the drainage is completed.

In a further solution of this embodiment, during the process of the washing machine performing the drainage and filtering operation, the delivery pump 400 is controlled to be turned on intermittently. By intermittently turning on the delivery pump 400, during the period when the delivery pump 400 is turned off, the water in the water container 100 stops passing through the filtering device 600, and the filtered impurities attached to the inside of the filtering device 600 can fall off and merge into the water during this period, and then be discharged with the water flow when the sewage discharge operation is performed. In this way, it is avoided that the water flow passes through the filtering device 600 for filtering for too long, resulting in the filtered impurities being too firmly attached to the inside of the filtering device 600 and unable to be fully discharged when the sewage discharge operation is performed.

At the same time, the intermittent opening of the delivery pump 400 can also prevent the delivery pump 400 from working continuously for a long time, thereby preventing the delivery pump 400 from overheating and extending the service life of the delivery pump 400.

In the specific solution of this embodiment, the drainage filtering operation includes the following steps:

S181, controlling the switching mechanism 712 to open the drainage outlet 703;

S182, turning on the delivery pump 400 and keep it on for a certain period of time;

S183, turning off the delivery pump 400;

S184, turning on the driving mechanism 660 to drive the filtering mechanism 620 to rotate in the filtering cavity 610 for a certain period of time;

S185, turning off the driving mechanism 660, and if the number of times step S182 is executed in this drainage filtering operation reaches a preset number, the drainage filtering operation is ended; otherwise, the process returns to step S182.

In the above scheme, when the delivery pump 400 is turned off, the filtering mechanism 620 is driven to rotate by the driving mechanism 660, so that the filter impurities attached to the outer wall of the filtering mechanism 620 can be peeled off under the dual effects of centrifugal force and agitated water flow, and merged into the water in the filtering cavity 610, which helps to fully remove the filter impurities attached to the outer wall of the filtering mechanism 620.

Furthermore, during a drainage filtering operation, the delivery pump 400 continues to operate for a fourth preset time $t_4$ after being turned on for the first time, and continues to operate for a fifth preset time $t_5$ after each subsequent turning on. The fourth preset time $t_4$ is greater than the fifth preset time $t_5$.

In the above scheme, the specific values of the fourth preset time length $t_4$ and the fifth preset time length $t_5$ can be obtained in advance through a large number of experiments and directly written into the control program of the washing machine. The fourth preset time length $t_4$ is specifically the time during which most of the mesh holes on the filter screen of the filtering mechanism 620 are covered by filtered impurities when the filtering device 600 continues to filter.

In a drainage filtering operation, when the delivery pump 400 is turned on for the first time, there is basically no filter impurities attached to the filter screen, so the fourth preset time length $t_4$ can be set to a larger value. During the period when the delivery pump 400 is turned off, even through the high-speed rotation of the filtering mechanism 620, it cannot be guaranteed that the filter impurities attached to the filter screen will completely fall off, that is, each time the delivery pump 400 is turned on, some filter impurities may be attached to the filter screen, so the value of the fifth preset time length $t_5$ is less than the fourth preset time length $t_4$ to prevent the filter screen from being blocked and affecting the filtering process.

Further, in step S184 of this embodiment, the continuous rotation time of the filtering mechanism 620 is the sixth preset time $t_6$, and the sixth preset time $t_6$ is shorter than the fifth preset time $t_5$.

The sixth preset time length to can be obtained in advance through a large number of experiments and directly written into the control program of the washing machine to ensure that the filtered impurities attached to the filtering mechanism 620 can be fully removed.

Figure 25:
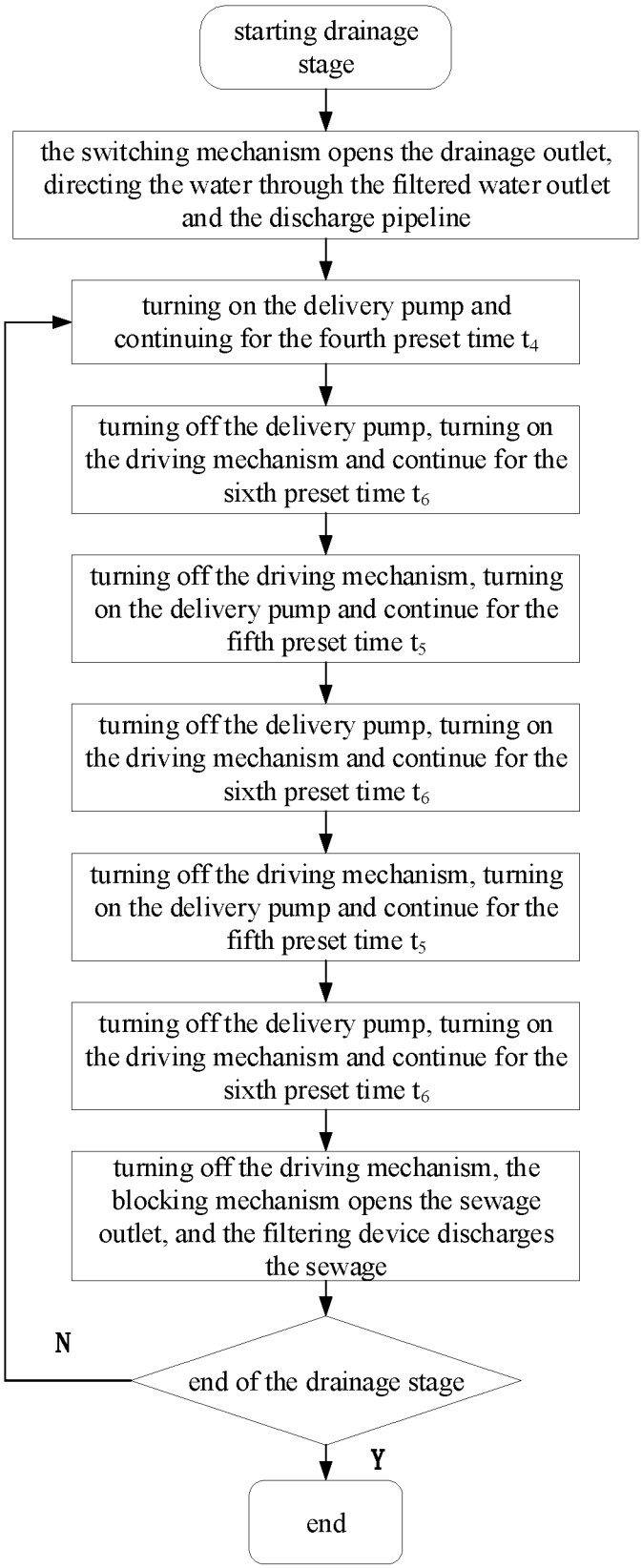
FIG. 25 is a control flow chart of the drainage stage of the washing machine in Embodiment 18 of the present disclosure.

FIG. 25 is a control flow chart of the washing machine of this embodiment in the drainage stage, including the following steps:

11) the switching mechanism opens the drainage outlet, directing the water through the filtered water outlet and the discharge pipeline;

12) turning on the delivery pump and continuing for the fourth preset time $t_4$;

13) turning off the delivery pump, turning on the driving mechanism and continue for the sixth preset time $t_6$;

14) turning off the driving mechanism, turning on the delivery pump and continue for the fifth preset time $t_5$;

15) turning off the delivery pump, turning on the driving mechanism and continue for the sixth preset time $t_6$;

16) turning off the driving mechanism, turning on the delivery pump and continue for the fifth preset time $t_5$;

17) turning off the delivery pump, turning on the driving mechanism and continue for the sixth preset time $t_6$;

18) turning off the driving mechanism, the blocking mechanism opens the sewage outlet, and the filtering device discharges the sewage;

19) repeating steps 12) to 18) until the drainage phase is completed.

In this embodiment, during the washing/rinsing process of the washing machine, the switching mechanism 712 keeps the circulating water outlet 702 open and blocks the drainage outlet 703, and the washing machine alternately performs the circulating filtering operation and the sewage discharge operation.

The circulation filtering operation includes: the delivery pump 400 is in an on state, the blocking mechanism 722 blocks the sewage outlet 705, and the water in the water container 100 is circulated and filtered.

Similar to the drainage process, when the washing machine circulates and filters the washing/rinsing water during the washing/rinsing process, it also alternately performs the circulation filtering operation and the sewage discharge operation to prevent the filtered impurities from accumulating in large quantities inside the filtering device 600 and causing blockage problems.

The specific steps of the circulation filtering operation are consistent with the drainage filtering operation, which also controls the delivery pump 400 to be turned on intermittently for filtering. The only difference is that during the circulation filtering operation, the switching mechanism 712 keeps the circulation water outlet 702 open instead of the drainage outlet 703 open.

Figure 26:
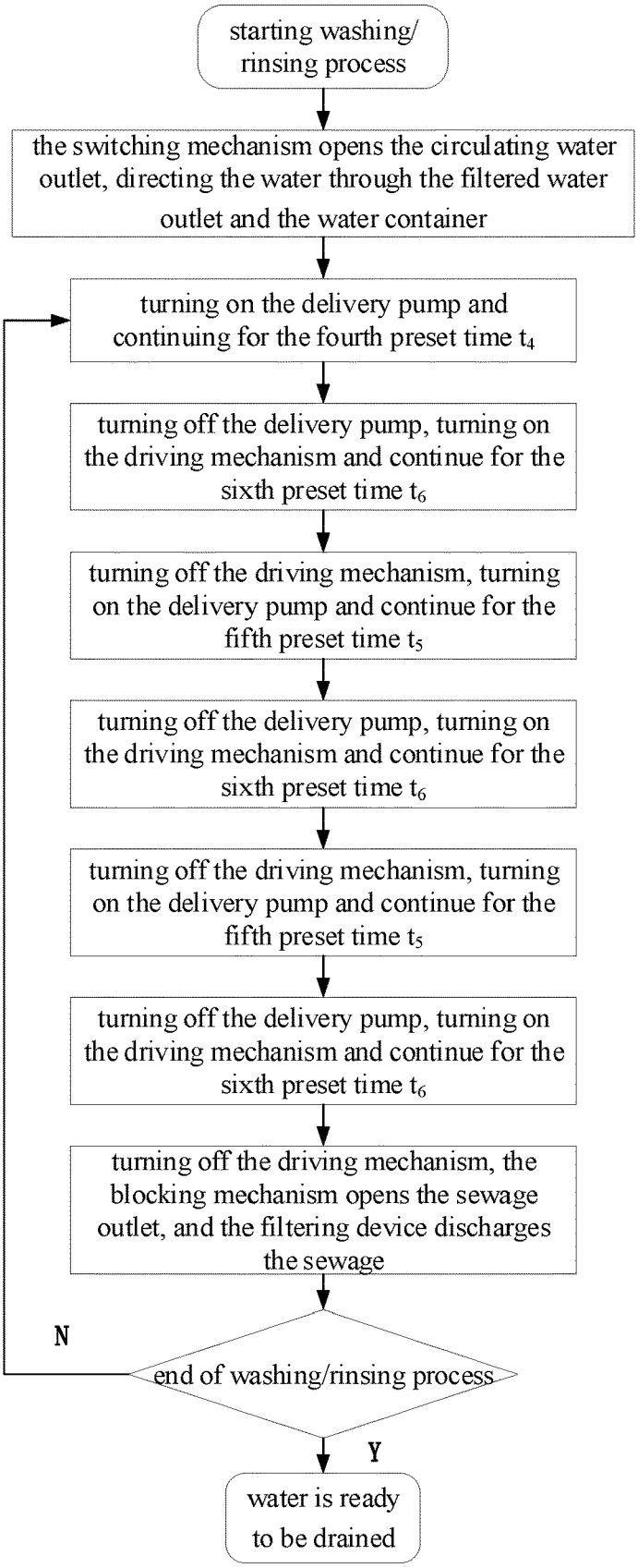
FIG. 26 is a control flow chart of the washing/rinsing process of the washing machine in Embodiment 18 of the present disclosure.

FIG. 26 is a control flow chart of the washing machine of this embodiment during the washing/rinsing process, including the following steps:

21) the switching mechanism opens the circulating water outlet, directing the water through the filtered water outlet and the water container;

22) turning on the delivery pump and continuing for the fourth preset time $t_4$;

23) turning off the delivery pump, turning on the driving mechanism and continue for the sixth preset time $t_6$;

24) turning off the driving mechanism, turning on the delivery pump and continue for the fifth preset time $t_5$;

25) turning off the delivery pump, turning on the driving mechanism and continue for the sixth preset time $t_6$;

26) turning off the driving mechanism, turning on the delivery pump and continue for the fifth preset time $t_5$;

27) turning off the delivery pump, turning on the drive mechanism and continue for the sixth preset time $t_6$;

28) turning off the driving mechanism, the blocking mechanism opens the sewage outlet, and the filtering device discharges the sewage;

29) repeating steps 22) to 28) until the washing/rinsing process is completed and the water is ready to be drained.

In this embodiment, the washing machine alternately performs the drainage filtering operation and the sewage discharge operation in the drainage stage, and alternately performs the circulation filtering operation and the sewage discharge operation in the washing/rinsing process, so that the filtered impurities remaining in the filtering device 600 can be discharged through the sewage outlet 6103 in time $t_6$ avoid the accumulation of filtered impurities affecting the filtering efficiency. During the drainage filtering operation or the circulation filtering operation, the delivery pump 400 is controlled to be turned on intermittently, and the filtering mechanism 620 is driven to rotate by the driving mechanism 660 during the period when the delivery pump 400 is turned off, so that the filtered impurities attached to the filtering mechanism 620 are fully detached and then fully discharged during the execution of the sewage discharge operation. Through the above process, the filtering device 600 can be self-cleaned at any time during the operation of the washing program, avoiding the blockage of the filtering device 600 and ensuring the filtering efficiency of the washing machine for water.

The above is only a preferred embodiment of the present disclosure, and does not limit the present disclosure in any form. Although the present disclosure has been disclosed as a preferred embodiment as above, it is not used to limit the present disclosure. Any technician familiar with this patent can make some changes or modify the technical contents suggested above into equivalent embodiments without departing from the scope of the technical solution of the present disclosure. However, any simple modification, equivalent change and modification made to the above embodiments according to the technical essence of the present disclosure without departing from the content of the technical solution of the present disclosure still fall within the scope of the solution of the present disclosure.

The invention claimed is:

1. A washing machine, comprising:

a water container;

a filtering device, being configured to communicate with the water container and to receive water from the water container for filtering, and has a sewage outlet for discharging sewage to outside;

wherein, the washing machine comprises a suction device, being configured to perform a suction action to drive the sewage in the filtering device to be discharged through the sewage outlet under an action of pressure difference; and a recovery device, being configured to collect the sewage discharged from the filtering device;

the suction device is connected to the sewage outlet of the filtering device and the recovery device through a suction pipeline, and performs the suction action according to an instruction, the sewage outlet of the filtering device is connected to a sewage temporary storage device having an internal cavity, the sewage temporary storage device is connected to the recovery device, and the suction pipeline is connected to the internal cavity of the sewage temporary storage device; and the suction device performs the suction action, and the sewage in the filtering device enters the sewage temporary storage device under the action of the pressure difference; the suction device is turned off, and the sewage in the sewage temporary storage device is discharged into the recovery device.

2. The washing machine according to claim 1, wherein a water outlet of the sewage temporary storage device is higher than a sewage inlet of the recovery device, the suction device is turned off, and the sewage in the sewage temporary storage device is discharged into the recovery device under an action of gravity;

and/or, the washing machine also includes an inflating device for introducing air into the sewage temporary storage device to drive the sewage therein to be discharged into the recovery device; or the suction device is also used for introducing air into the sewage temporary storage device to drive the sewage therein to be discharged into the recovery device.

3. The washing machine according to claim 1, wherein a buffer portion is arranged between the suction device and the sewage temporary storage device, and a buffer chamber is provided inside the buffer portion; the buffer chamber is communicated with the internal cavity of the sewage temporary storage device, and the suction pipeline is connected to the buffer portion to conduct the suction device and the buffer chamber.

4. The washing machine according to claim 1, wherein an openable/closable sewage valve is provided between the sewage outlet of the filtering device and a suction inlet end of the suction pipeline.

5. The washing machine according to claim 4, wherein the sewage outlet of the filtering device is connected to the sewage temporary storage device having the internal cavity, the sewage temporary storage device is connected to the recovery device, the suction pipeline is connected to the sewage temporary storage device, and the sewage valve is arranged between the sewage outlet of the filtering device and the sewage temporary storage device.

6. The washing machine according to claim 1, wherein the recovery device comprises:

a housing with a recovery chamber therein;

a filter component is disposed in the recovery chamber and divides the recovery chamber into a first chamber and a second chamber;

the sewage carrying filtered impurities enters the first chamber, and enters the second chamber after being filtered by the filter component, the filtered impurities are collected in the first chamber.

7. The washing machine according to claim 1, wherein a blocking member that conducts one-way from outside to inside is arranged at a sewage inlet of the recovery device; or, the recovery device is provided with a water outlet, and the blocking member that conducts one-way from inside to outside is arranged at the water outlet.

8. The washing machine according to claim 7, wherein the blocking member is arranged at the sewage inlet of the recovery device and is one-way conducted from outside to inside; the blocking member comprises:

a base body, mounted on the sewage inlet of the recovery device;

an opening portion, being movable relative to the base body to open/close space outside and inside the recovery device.

9. The washing machine according to claim 8, wherein an outer periphery of the sewage inlet extends a certain length from an inner wall of the recovery device to the inside of the recovery device to form a tubular portion; the base body is installed at an extended end of the tubular portion, and the opening portion is relatively movable with the extended end of the tubular portion to open/block an opening of the extended end of the tubular portion.

10. The washing machine according to claim 1, comprising:

the sewage temporary storage device, having an internal cavity connected to the sewage outlet of the filtering device;

the recovery device, being configured to connect to the internal cavity of the sewage temporary storage device, and the sewage discharged by the filtering device is collected in the recovery device through the sewage temporary storage device;

the suction device, being configured to perform a suction action to drive the sewage in the filtering device into the sewage temporary storage device under an action of pressure difference.

11. The washing machine according to claim 10, wherein the sewage temporary storage device is provided with a first vent hole connected to the suction device.

12. The washing machine according to claim 11, wherein the sewage temporary storage device is provided with an air hole for connecting the internal cavity of the sewage temporary storage device with the outside;

the suction device performs the suction action, and the sewage in the filtering device enters the sewage temporary storage device under the action of the pressure difference; the suction device is turned off, and the external air enters the internal cavity of the sewage temporary storage device through the air hole, driving the sewage therein to be discharged into the recovery device.

13. The washing machine according to claim 11, wherein a buffer portion is provided between the suction device and the sewage temporary storage device, and a buffer chamber is provided inside the buffer portion; the buffer chamber is communicated with the first vent hole on the sewage temporary storage device, and the suction device is communicated with the buffer chamber.

14. The washing machine according to claim 13, wherein the buffer portion is provided with a second vent hole connected to the suction device.

15. The washing machine according to claim 1, wherein, the washing machine comprises:

an isolation mechanism, being arranged between the sewage outlet and the suction device, and disconnects a connection between the suction device and the sewage outlet as the sewage is discharged.

16. The washing machine according to claim 15, wherein the isolation mechanism comprises a floating member, and an air vent is provided on a communication path between the suction device and the sewage outlet; during the sewage discharge process, the floating member rises with a water surface to the air vent to block the air vent.

17. The washing machine according to claim 1, wherein the washing machine comprises:

a suction device, being configured to perform a suction action to pump out the sewage in the filtering device through the sewage outlet;

a recovery device, being configured to collect and filter the sewage pumped out by the suction device, and filtered water is passed into the water container.

18. The washing machine according to claim 17, wherein the washing machine also includes a detergent dispensing device connected to the water container and used for dispensing detergent into the water container; the recovery device is connected to the detergent dispensing device, and the filtered water in the recovery device is passed into the water container through the detergent dispensing device.

* * * * *